US005390016A

United States Patent [19]

Hoshi et al.

[11] Patent Number: 5,390,016

[45] Date of Patent: Feb. 14, 1995

[54] IMAGE FORMING APPARATUS AND METHOD FOR PREFEEDING A SHEET TO A CONVEYING PATH FROM A SHEET ACCOMMODATING DEVICE PRIOR TO GENERATION OF A SHEET FEEDING SIGNAL

[75] Inventors: Akimitsu Hoshi, Kawasaki; Masaaki Sato, Yokohama; Norifumi Miyake, Kawasaki; Kenji Kobayashi, Tokyo, all of Japan

[73] Assignee: Canon Kabushiki Kaisha, Tokyo, Japan

[21] Appl. No.: 79,216

[22] Filed: Jun. 21, 1993

Related U.S. Application Data

[63] Continuation of Ser. No. 625,972, Dec. 11, 1990, abandoned.

[30] Foreign Application Priority Data

Dec. 11, 1989 [JP] Japan ..... 1-321645

[51] Int. Cl.[6] ..... G03G 21/00; B65H 7/00

[52] U.S. Cl. ..... 355/308; 271/9; 355/311

[58] Field of Search ..... 355/308, 309, 311, 316, 355/317; 271/9, 264, 265, 266

[56] References Cited

U.S. PATENT DOCUMENTS

| | | | |
|---|---|---|---|
| 4,723,129 | 2/1988 | Endo et al. | 346/1.1 |
| 4,740,796 | 4/1988 | Endo et al. | 346/1.1 |
| 4,918,489 | 4/1990 | Inage et al. | 355/309 |
| 4,939,554 | 7/1990 | Hirabayashi et al. | 355/317 |
| 4,962,404 | 10/1990 | Wakikaido et al. | 355/317 X |
| 4,967,240 | 10/1990 | Kitano et al. | 355/309 X |
| 5,018,714 | 5/1991 | Honjo et al. | 271/3.1 |
| 5,056,769 | 10/1991 | Ikenoue et al. | 271/9 |
| 5,072,924 | 12/1991 | Sugiyama | 271/265 X |

FOREIGN PATENT DOCUMENTS

| | | | |
|---|---|---|---|
| 57-40955 | 3/1982 | Japan . | |
| 58-216850 | 12/1983 | Japan . | |
| 59-223635 | 12/1984 | Japan | 271/9 |
| 62-175359 | 8/1987 | Japan . | |
| 63-127934 | 5/1989 | Japan . | |

*Primary Examiner*—Fred L. Braun

*Attorney, Agent, or Firm*—Fitzpatrick, Cella, Harper & Scinto

[57] ABSTRACT

An image forming apparatus and method includes a sheet accommodating device, a feeder, an image former, a sheet conveying path, and a controller. The sheet accommodating device accommodates a stack of sheets. The sheet accommodating device is movable in a direction crossing with the feeding direction for the sheets. The feeder feeds one-by-one the sheets from the sheet accommodating device. The image former forms an image on a sheet sent from the sheet accommodating device by the feeder. The sheet conveying path has a sufficient length to retain the sheet from the sheet accommodating device between the feeder and the image former so that a trailing edge of the sheet is downstream of the feeder. The controller pre-feeds the sheet to the sheet conveying path from the sheet accommodating device prior to the generation of a sheet feeding signal.

36 Claims, 28 Drawing Sheets

IMAGE FORMING APPARATUS AND METHOD FOR PREFEEDING A SHEET TO A CONVEYING PATH FROM A SHEET ACCOMMODATING DEVICE PRIOR TO GENERATION OF A SHEET FEEDING SIGNAL

This application is a continuation of application Ser. No. 07/625,972 filed Dec. 11, 1990, now abandoned.

FIELD OF THE INVENTION AND RELATED ART

The present invention relates to an image forming apparatus such as a copying machine and a sheet feeding apparatus of a front loading type, particularly to such a sheet feeding apparatus capable of feeding the sheets at a high speed.

Japanese Laid-Open Utility Model Application No. 40955/1982 and Japanese Laid-Open Patent Application No. 127934/1985 have proposed a sheet feeding apparatus attachable to an image forming apparatus such as a copying machine. In such sheet feeding apparatus, the distance between the stacked sheets on the deck and the registration rollers or the copying machine is longer than in the case of cassette sheet feeding or in the case of built-in sheet feeding apparatus in the copying machine.

In the case where the distance between the stacked sheet and the registration rollers or the photosensitive drum of the main assembly is long, the following problems arise.

1. The production of a first copy is delayed. Since the sheet feed is started after the actuation of the copy button, the first copy is naturally delayed in order to convey the sheet through a long distance.

2. When one set of copies is to be obtained from one set of originals, it possibly occurs that upon detection of the final original on the document feeder, an additional feed has already been supplied in vain, if the sheet feed passage of the deck is long.

This is because if the sheet feed is started after receiving the sheet feed signal from the main assembly, the sheets are not fed to match the speed of the continuous copy operation. This sheet is called flying paper or sheet. The flying sheet is a wasted sheet. Usually, it is required to decrease the copy speed to provide longer sheet intervals. In other words, the sheet feed has to be started only after receiving the sheet feed signal from the main assembly. Then, the productivity of the copying machine decreases.

3. As a measure to prevent the delay of the first copy discussed in paragraph 1, a predetermined length of the leading portion of the sheet is fed from the deck, but the trailing portion thereof remains in the deck. Therefore, if this feature is used in a front loading type deck, the sheet has to be returned to the stack of the sheets on the deck, since otherwise the sheet is torn. Therefore, a mechanism is required to return the sheet. Particularly, it is very difficult to move the sheets in two directions at a separating position where the sheets are singled out.

SUMMARY OF THE INVENTION

Accordingly, it is a principle object of the present invention to provide a sheet feeding apparatus and an image forming apparatus wherein the distance from the registration rollers of the main assembly to the separating position in the sheet feeding apparatus is deliberately made longer so that a trailing edge of the sheet pre-fed is disposed downstream of the sheet separating position with respect to the sheet conveyance direction.

According to an embodiment of the present invention, the sheet feeding apparatus comprises sheet accommodating means for accommodating sheets, the sheet accommodating means being movable in a direction crossing with the sheet feeding direction, as in a front loading system, feeding means for feeding the sheets one by one from the sheet accommodating means, wherein images are formed on the sheets fed from the sheet accommodating means, by image forming means, characterized in that there is provided a sheet conveyance passage between the feeding means and the image forming means, and the passage has a sufficient length to retain a sheet before it is fed to the image forming means.

In the passage, the sheet fed from the sheet accommodating means fed out prior to a sheet feed signal is retained.

The sheet is retained at a predetermined position in the sheet conveying passage.

When the sheet accommodated in the sheet accommodating means is smaller than a predetermined size, the sheet is first retained in the conveyance passage, but if the size is larger than the predetermined size, the sheet is supplied without the retention.

According to an embodiment of the present invention, the distance between a trailing edge of the pre-fed sheet and the sheet stacked on the deck is determined to be smaller than the sheet intervals during the continuous copy, so that it does not occur that only the second copy is delayed upon the start of the copying operation, and therefore, the copying operation is performed always at the proper timing. A large size sheet is started to be fed in response to a sheet feed signal from the main assembly of the copying machine, and such a small size sheet that without the pre-feed, the continuous copy speed cannot be maintained, is pre-fed. Therefore, in an attachable sheet feeding apparatus resulting in a long sheet feed passage, the sheet can be fed without delaying the production of the first copy. The productivity of the copying apparatus can thus be maintained.

In addition, since the pre-fed sheet is completely away from the deck, the pre-fed sheet is not done when the deck is drawn out for the purpose of supplying the sheets.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Referring to FIGS. 1–28, an embodiment of the present invention will be described. A sheet feeding apparatus according to the embodiment is in the form of a front loading deck having a large capacity and attachable to a side of a copying machine which is an exemplary image forming apparatus. It has separable upper and lower units. Upon the occurrence of sheet jam, the upper unit is slidable to open the sheet passage.

Figure 1:
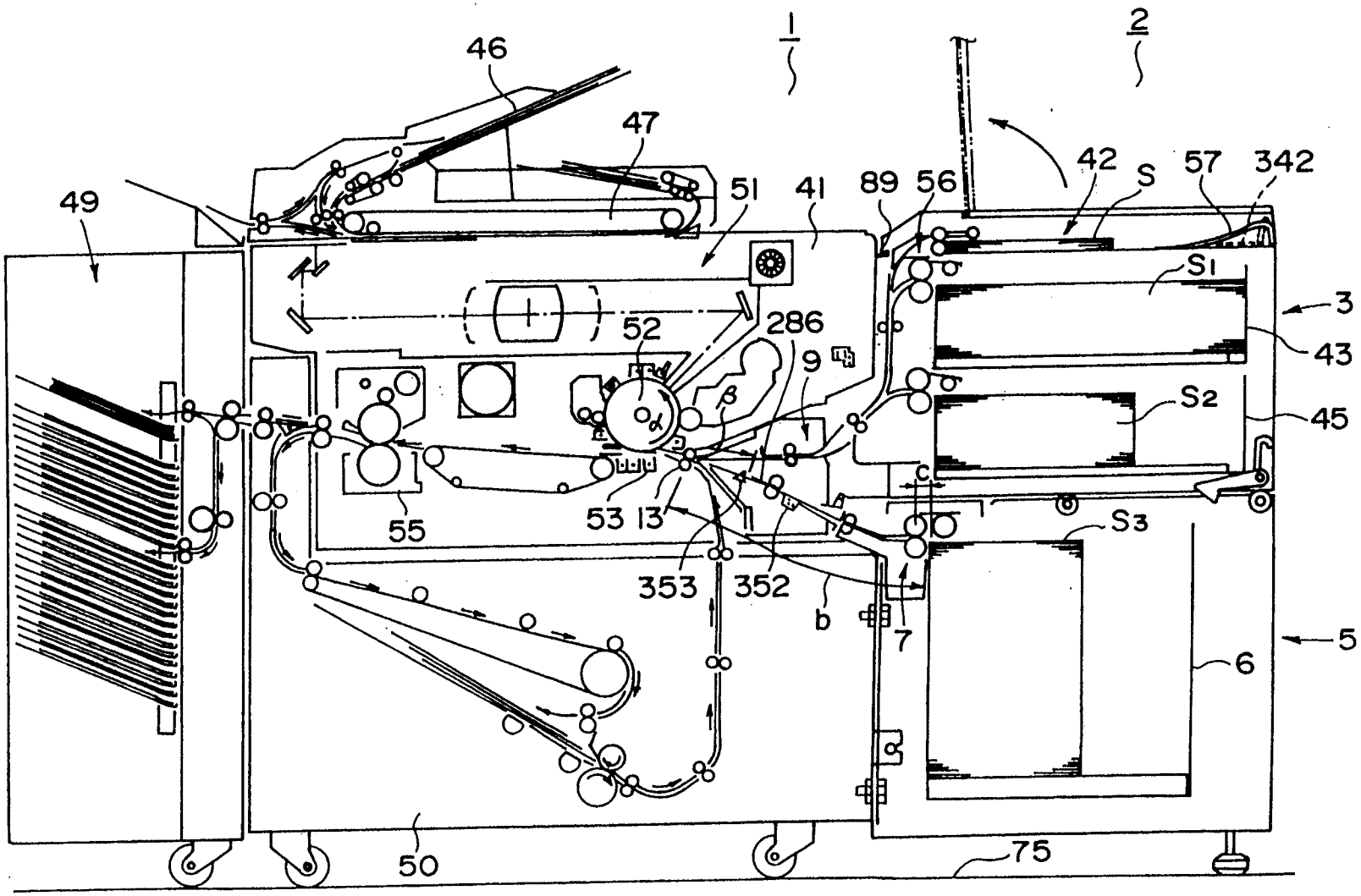
FIG. 1 shows a general arrangement of a copying machine and a sheet feeding apparatus according to a first embodiment of the present invention.

In FIG. 1, the sheet feeding apparatus 2 is connected with a main assembly 41 of the copying machine 1 (image forming apparatus). It has an upper unit 3 and a lower unit 5 which are vertically arranged and separable from each other. The upper unit 3 has a manual feeding station capable of stacking approximately 50 sheets S, an upper deck 43 and middle deck 45 capable of stacking approximately 1000 sheets S, and the lower unit 5 has a lower deck 6 capable of stacking approximately 3000 sheets S.

The copying machine 1 is designed so as to be used with cassettes containing sheets. In order to operatively couple the sheet feeding apparatus 2 of this embodiment with the copying machine 1, the unit of the cassette feeding station of the copying machine 1 is replaced as a whole with a suitable guide and roller coupled to constitute a sheet conveying passages of the sheet feeding apparatus 2. The sheet conveyance passages for this purpose are called hereinafter "an interface unit". The interface unit has passages connected with the upper unit 3 and the lower unit 5, as will be described hereinafter.

The detail of the structure of the sheet feeding apparatus according to this embodiment will be described in conjunction with FIGS. 1–23.

FIG. 1 is a longitudinal sectional view of the sheet feeding apparatus 2 and the copying machine 1 connected thereto. The copying system including the copying machine 1 comprises an original handling device 43 disposed at the top of the copying machine 1 and is effective to automatically feeding originals 46, a post processing device 49 such as a sorter, and an automatic duplex printing device 50 which functions as a base for supporting the copying machine 1 and which functions to form images on both sides of a sheet S.

In the main assembly 41, there are an optical system 51 for scanning the originals 46, a photosensitive drum 52 on which a toner image is formed by the exposure through the optical system 51 and by a developing device, an image transfer station 53 for transferring the toner image onto the sheet S and an image fixing device 55 for fixing the toner image, and the like.

The sheet feeding apparatus 2 is generally constituted by eight units, namely, the upper unit 3, the lower unit 5 which are vertically arranged and separable from each other, a manual sheet feeding station 42 above the upper unit 3, the upper deck 43 in the upper unit 3, a lower deck 45 in the upper unit 3, an upper sheet feeding unit 56 for feeding the sheets S out of the decks 43 and 45, a lower deck 6 in the lower unit 5 and a lower sheet feeding unit 7 for feeding the sheets out of the lower deck 6. The sheet feeding apparatus 2 is provided with the interface unit 9 which replaces the cassette sheet feeding unit provided originally in the copying machine 1.

Figure 2:
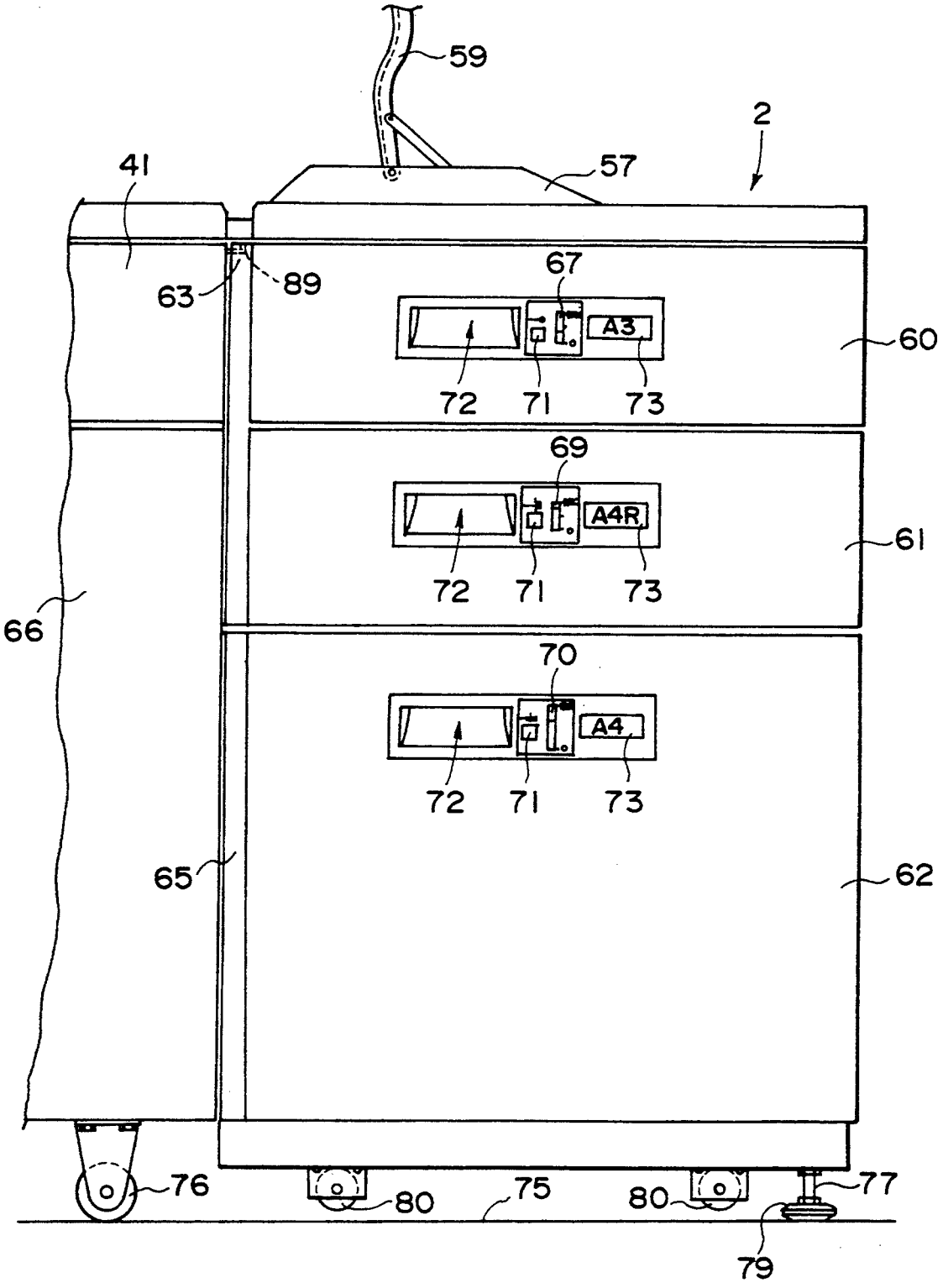
FIG. 2 is a front view of the sheet feeding apparatus.

FIG. 2 is a front view of the sheet feeding apparatus 2. The top of the sheet feeding apparatus 2 is provided with a cover 57 for covering the manual feeding station 42. The cover 57 has an openable transparent cover 59 to prevent foreign matter such as dust from the entering the manual sheet feeding station 42. The space between the main assembly 41 of the copying machine 1 and front covers 60, 61 and 62 of the decks 43, 45 and 46 of the sheet feeding apparatus 2 is covered by gap covers 63 and 65.

Figure 3:
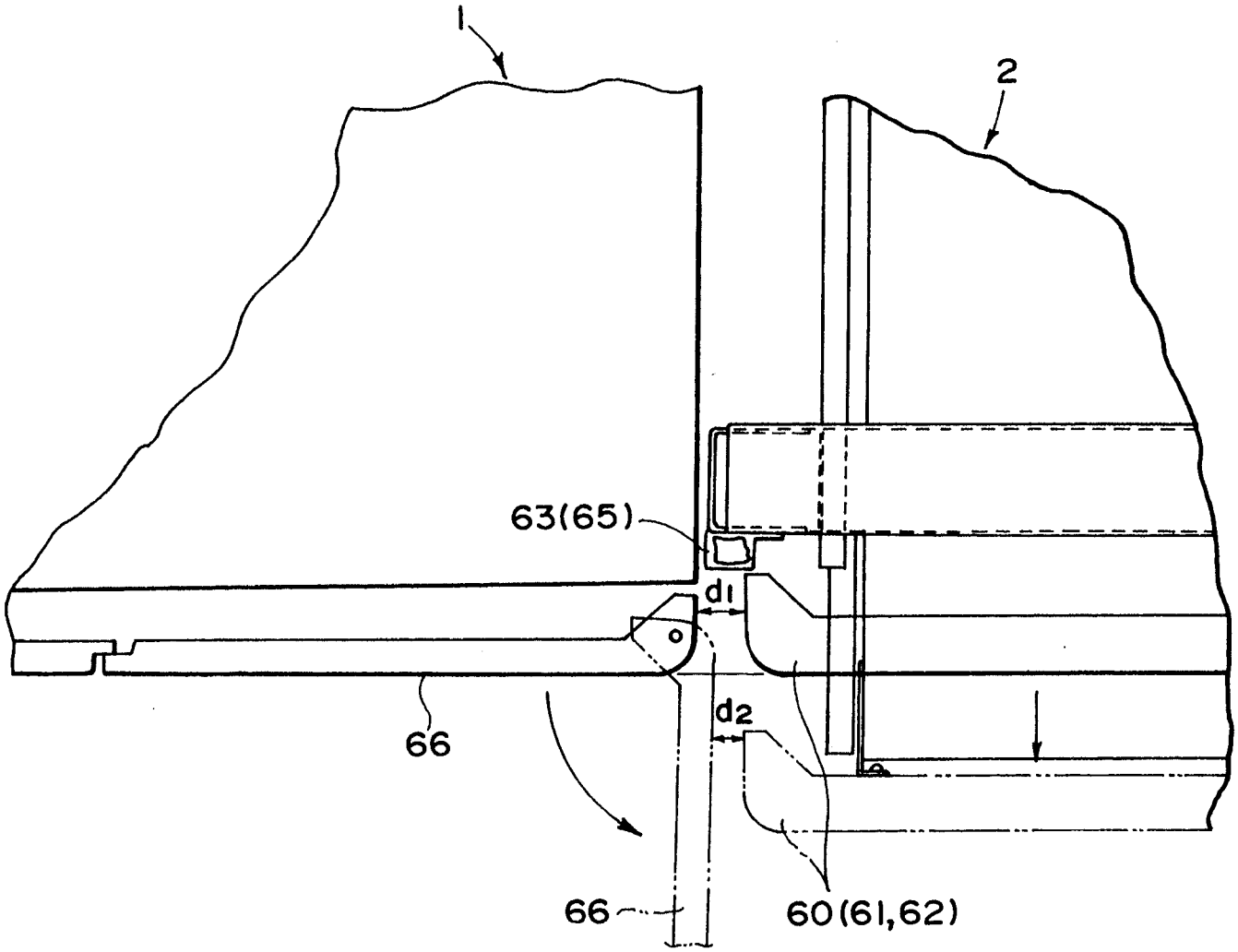
FIG. 3 is a top plan view thereof.

FIG. 3 is a top plan view of the sheet feeding apparatus 2 of FIG. 2. As will be understood from this figure, the front door 66 of the copying machine 1 is substantially flush with the front covers 60, 61 and 62. A clearance $d_1$ is required to prevent interference among the front door 66, the decks 43, 45 and 46, when the front door 66 is opened or when the decks 43, 45 and 46 are drawn out. The above described covers 63 and 65 cover the clearance $d_1$.

In FIG. 2, the front covers 60, 61 and 63 are provided with remainder displays 67, 69 and 70 for displaying remainder amounts of the sheets S of the decks 43, 45 and 6. Since the lower deck 6 has the capacity of 3000 sheets, the length of the remainder display is larger than those of the other displays. The decks 67, 69 and 70 are locked against drawing out, by an electric solenoid, as will be described in conjunction with FIG. 14.

A releasing switch 71 functions to release the locking condition. When the releasing switch 71 is depressed, a lifter of each of the decks 43, 45 and 6 lowers, and the locking is released, so that the decks 43, 45 and 6 are permitted to be drawn out. Each of the front covers 60, 61 and 62 is provided with a grip 72 and a sheet size display 73.

To the bottom surface of the main assembly 41, plural casters 76 are fixed in contact with the floor 75. The bottom surface of the sheet feeding apparatus 2 is provided with legs 77 having adjusters 79 adjacent the free end of the sheet feeding apparatus 2, and is provided with plural casters 80. When the sheet feeding apparatus 2 is set relative to the copying machine, the casters 80 are away from the surface of the floor 75, and therefore, the sheet feeding apparatus 2 is supported by the casters 76.

Figure 4:
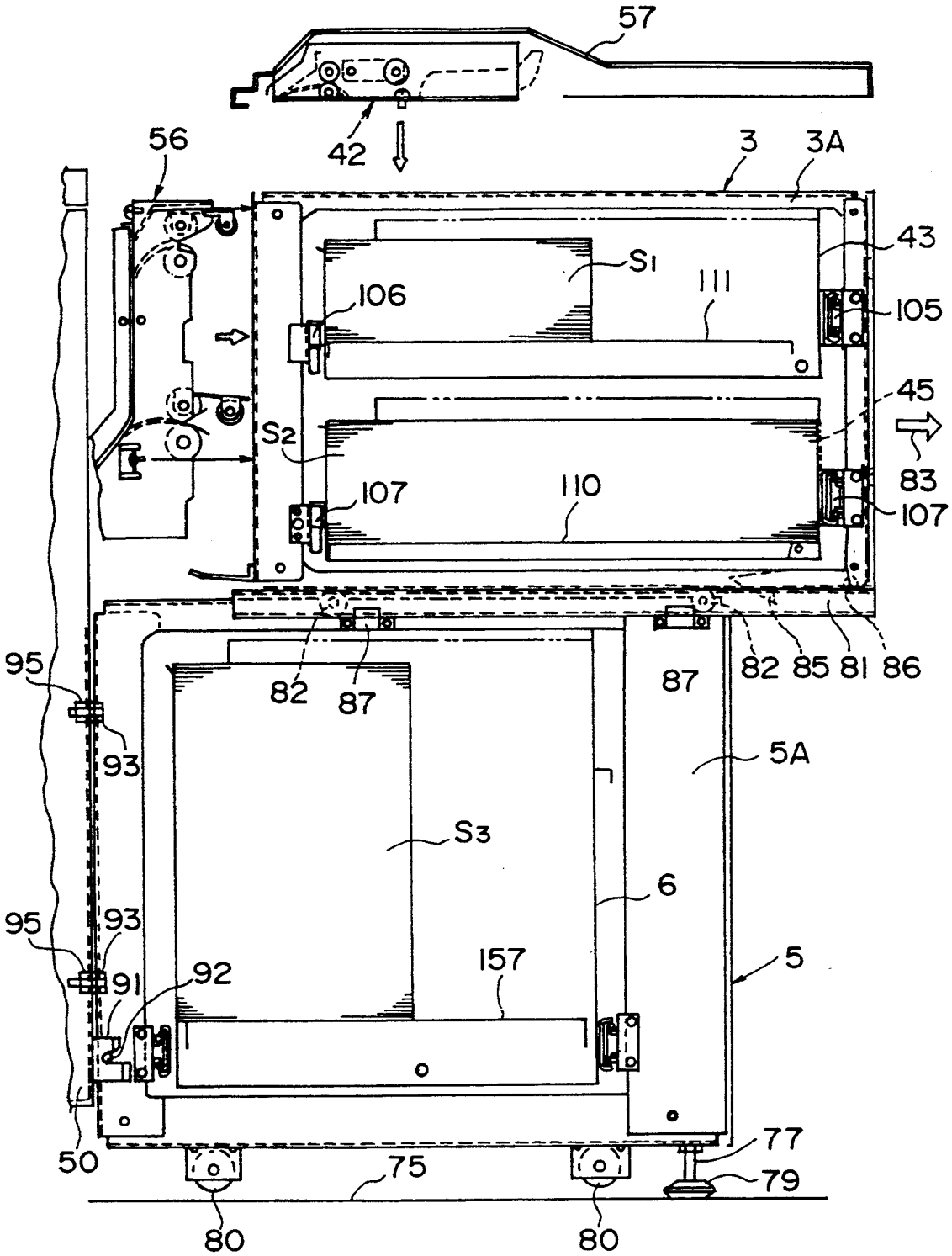
FIGS. 4 and 5 are sectional front views thereof.

FIG. 4 shows the inside of the apparatus when the front covers 60, 61 and 62 at the gap covers 63 and 65 are dismounted. Rails 81 fixedly mounted on a frame 3*a* of the upper unit 3 are slidably supported on a frame 5A of the lower unit 5 through a bearing 82, so that the upper unit 3 is slidable in the direction indicated by an arrow 83. A locking pawl 85 is mounted on the frame 3*a* about a pin 86. By engaging and disengaging the locking pawl 85 with one of the bearings 82, the upper unit 3 is locked or released.

A rail guide 87 fixedly mounted on the frame 5A is provided only for the front side rail 81 of the front and rear rails 81. As shown in FIG. 6, when the upper unit 3 is slid, it guides the rail 81 for rectilinear movement. FIG. 6 is a side view as seen from the right of FIG. 5. In FIGS. 1 and 2, between the main assembly 41 of the copying machine 1 and the manual feeding station 42, a receiving member 89 which opens upwardly is fixedly mounted on the main assembly 41. The receiving member 89 is effective to prevent foreign matter such as paper clip or the like from falling to the sheet feed passage.

Referring to FIGS. 4 and 6, a description will be made as to how to set the sheet feeding apparatus 2 relative to the main assembly 41 of the copying machine 1.

In FIG. 4, to the bottom of the main assembly 41, there is fixedly mounted a positioning member 91 having upper and lower arms constituting a groove. A positioning pin 92 engageable with and disengageable from the positioning member 91 is fixedly mounted on the frame 5A. When the sheet feeding apparatus 2 is set, the positioning pin 92 is engaged with the positioning member 91, by which the sheet feeding apparatus 2 is correctly positioned relative to the main assembly 41. The lower arm of the positioning member 91 is slightly longer than the upper arm, and they constitute a guide. When the sheet feeding apparatus 2 is set, the lower unit 5 is pushed to the main assembly 41 with the positioning pin 92 on the lower arm extending horizontally. When the lower unit 5 is brought into contact with the automatic duplex copying device 50 functioning as the base for supporting the copying machine, the lower unit 5 is positioned only in the vertical direction.

Then, the adjuster 79 is operated so that the level of the sheet feeding apparatus 2 is adjusted to be at the same level as the main assembly 41. Finally, the frame 5A of the lower unit 5 and the frame of the automatic duplex copying device 50 are securedly fixed by bolts 93 and nuts 95, by which the sheet feeding apparatus 2 is correctly positioned in the lateral direction (left-right direction), and is connected with the copying machine. At the end, the caster 80 of the sheet feeding apparatus 2 are away from the floor 75, and therefore, the sheet feeding apparatus 2 can be correctly connected with the copying machine 1 even if the floor 75 is more or less wavy.

The positioning pin 92 is provided at each of the front and rear sides. The vertical positioning of the sheet feeding apparatus adjacent the main assembly 41 is not as is disclosed in Japanese Laid-Open Patent Application No. 127934/1988 in which the sheet feeding apparatus is simply placed on the floor. Therefore, the sheet feeding apparatus 2 is correctly positioned relative to the copying machine in this embodiment. The vertical positioning of the sheet feeding apparatus 2 is effected about a pivot in the form of a pin, and therefore, the sheet feeding apparatus 2 is rotatable when the adjuster 79 is operated, and therefore, the horizontal adjustment can be effected without difficulty.

In FIG. 6, the positioning of the sheet feeding apparatus 2 in the left-right direction, is accomplished by sandwiching the front part 3*a* of the frame 5A by the positioning member 91. The rear positioning member 91*a* supports the rear side of the lower unit 5. The positioning member 91*a* provides a wider space so that it does not nip with a strong force the rear part 5*b* of the frame 5A.

Figure 21:
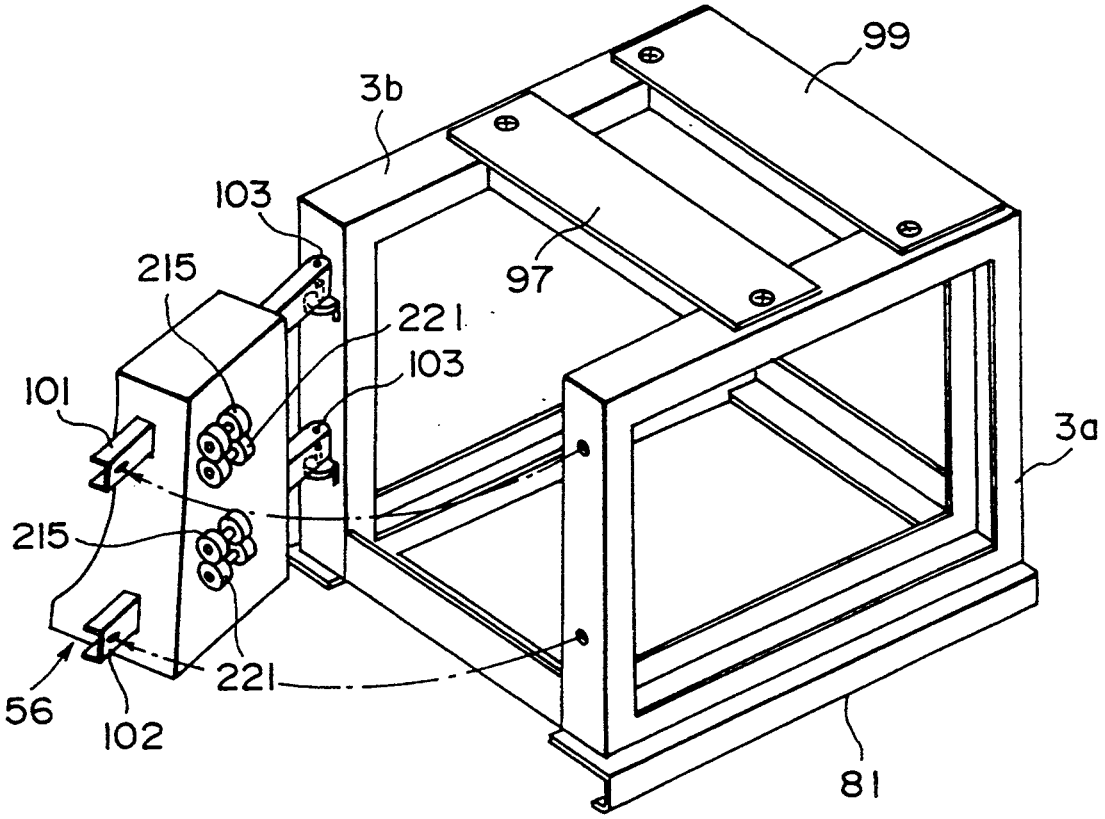
FIG. 21 is a perspective view of the upper sheet feeding unit.

FIG. 21 is a perspective view of the structure of the frame 3A of the upper unit 3. Frames 3A and 3B each in the form of a window are fixed by bottom stays 96, top stays 97 and corner stays and the like. The frames 3A and 3B are produced by welding, and the accuracy and the rigidity of the entire sheet feeding apparatus 2 is maintained by the frames 3A and 3B.

Figure 5:
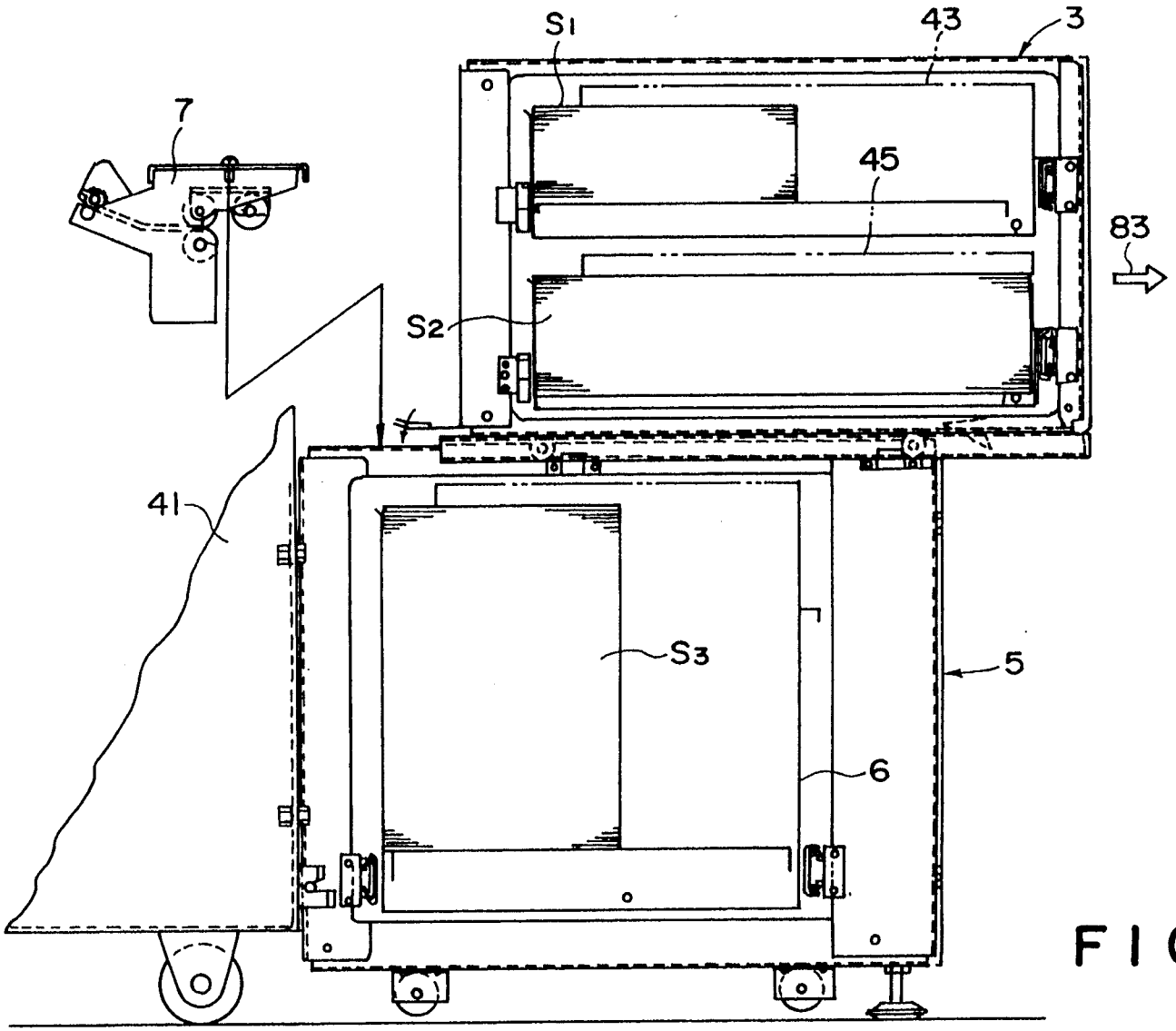
Figure 6:
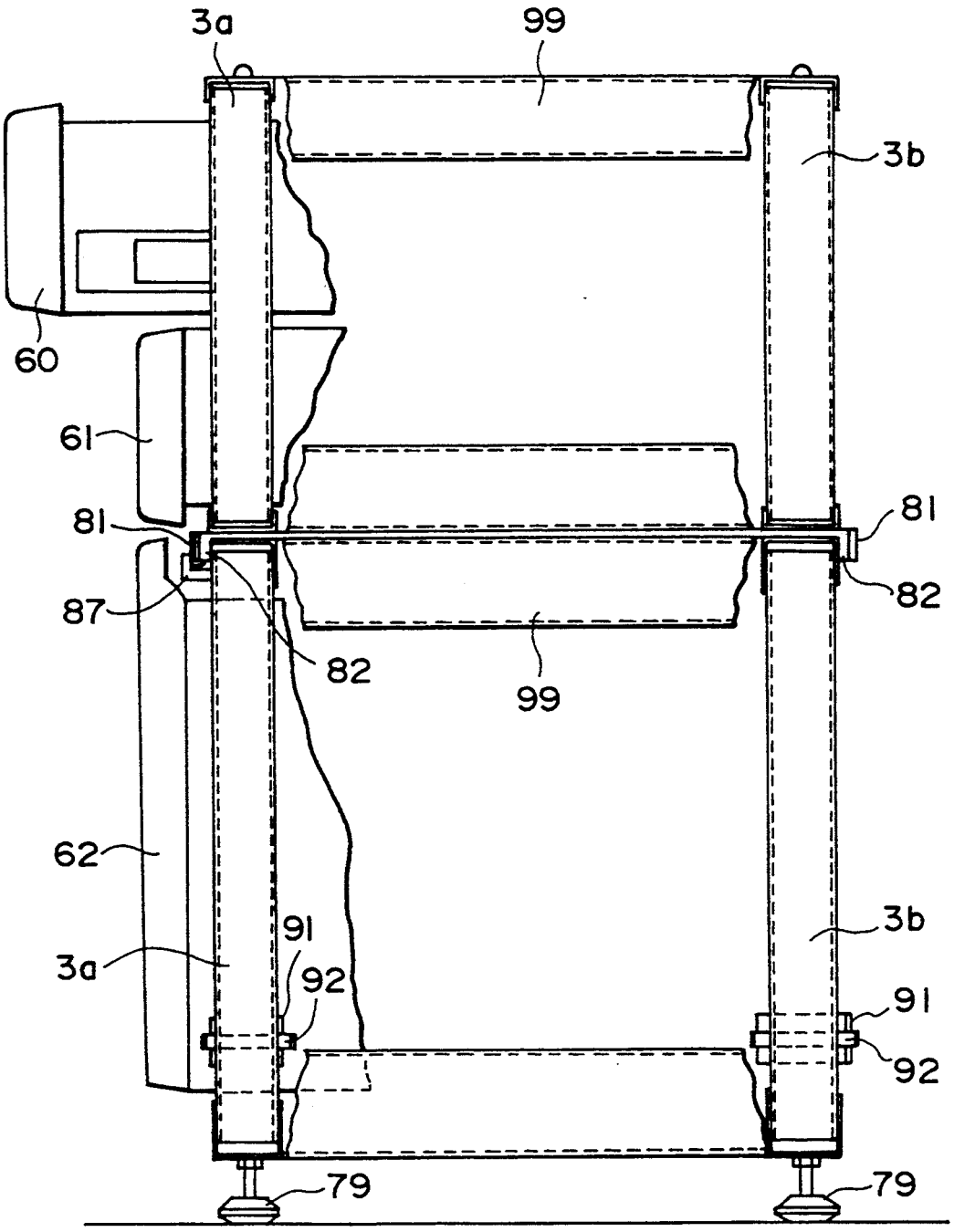
FIG. 6 is a perspective view of the sheet feeding apparatus as seen from the right side of FIG. 4.

Referring to FIGS. 4 and 5, the structures of the units of the sheet feeding apparatus 2 will be described.

The upper unit 3 and the lower unit 5 have been dealt with in the foregoing, and a description thereof will be omitted here. The manual sheet feeding device 42 is mounted to the top of the frame 3A by screws. The upper sheet feeding unit 56 is mounted from the left side of the upper unit 3 so that it can be mounted or dismounted when the upper unit 3 is slid in the direction 83 (FIG. 4). The upper sheet feeding unit 56 is slidably supported on the upper and lower stays 101 and 102. The base portions of the stays 101 and 102 are rotatably mounted on the frame 3*b* about a pin 103 (FIG. 21). Since the upper sheet feeding unit 56 is mounted on the frame 3*b* with a hinge structure, the mounting and the servicing of the upper sheet feeding unit 56 is improved.

As shown in FIG. 5, the lower sheet feeding unit 7 is mounted from the top of the frame 5A, and is mounted by screws. In this case, the upper unit 3 is slid in the front-rear direction (left-right direction in FIG. 5), so that the mounting and dismounting of the lower sheet feeding unit 7 is permitted. As shown in FIG. 4, the upper/middle decks 43 and 45 are mounted in the frame 3A through rails 105 and 106, so that they can be drawn out to the front. The lower deck 6 is drawably mounted in the frame 5A on plural rails 107.

Figure 7:
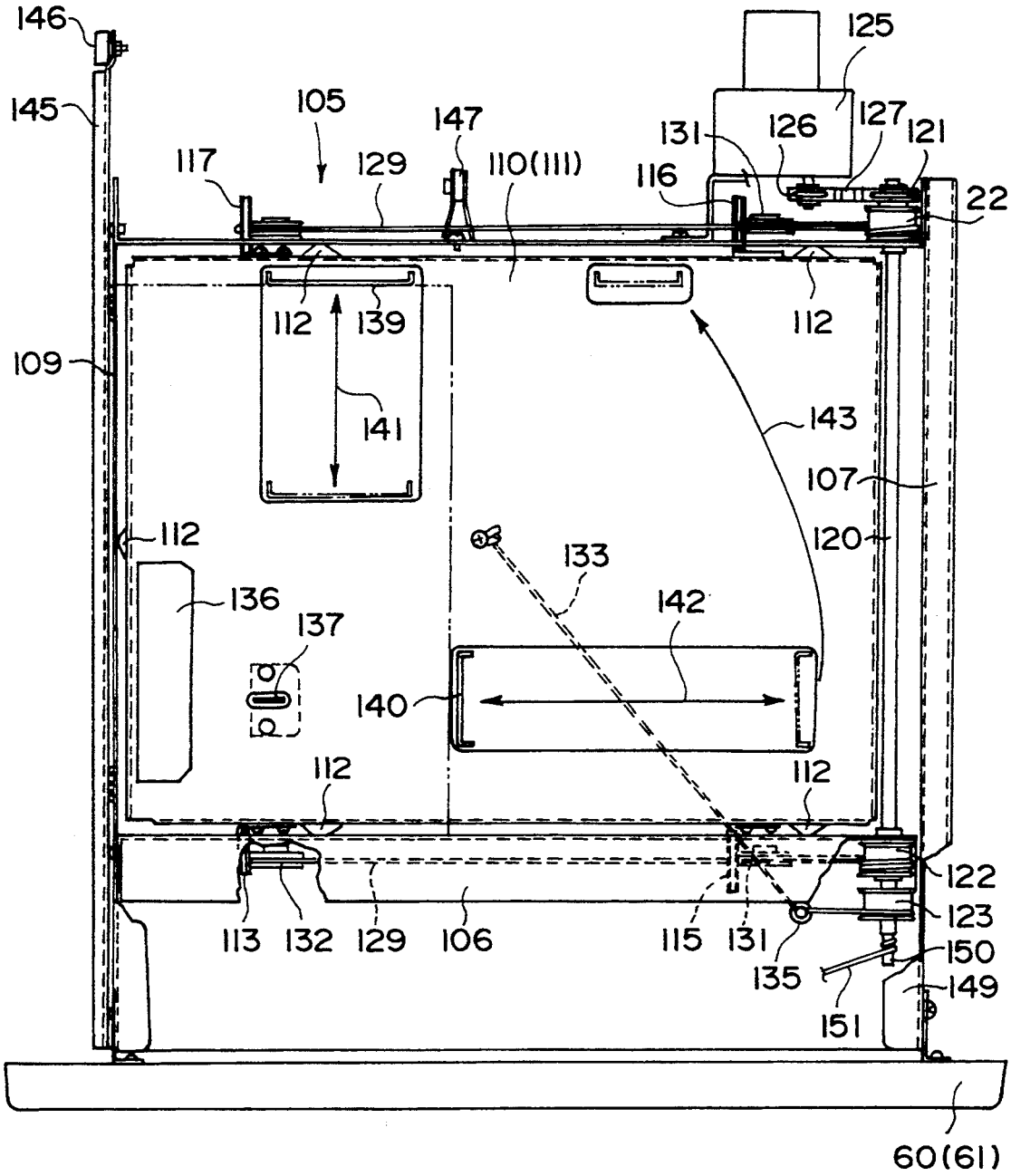
FIG. 7 is a top plan view of an upper/lower deck.
Figure 8:
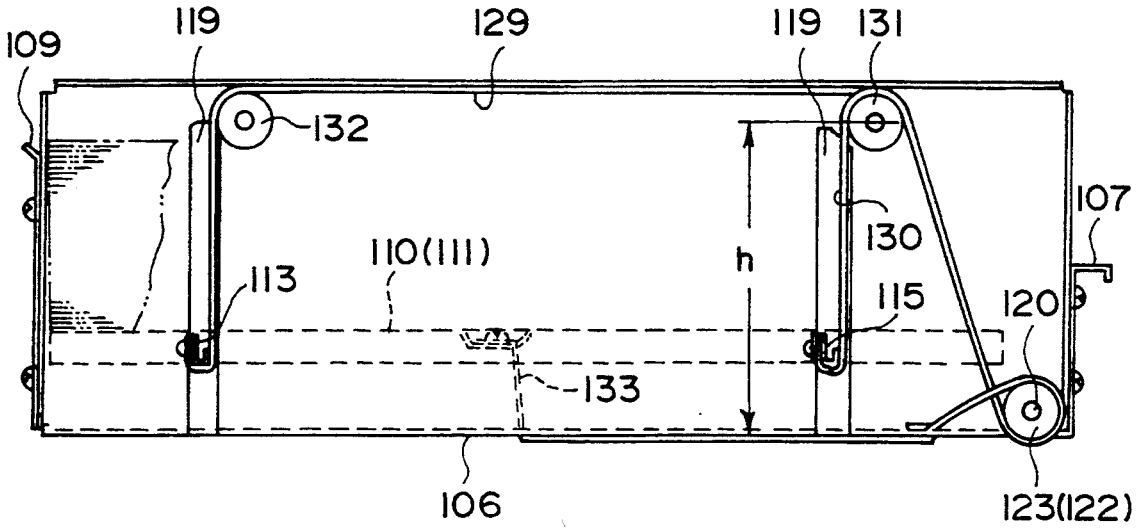
FIG. 8 is a front view thereof.

Referring to FIGS. 7 and 8, the upper/middle decks 43 and 45 will be described.

The upper and middle decks 43 and 45 are constituted by the same parts. The only difference is in the position where they are mounted on the front panels 60 and 61, and therefore, in the figures, the same reference numerals are assigned to corresponding elements.

A casing 105 for the upper or middle deck 43 or 45 is constituted as a box opening upwardly, with a bottom casing 105 in the form of a channel, a right side plate 107 and a left side plate 109. In the casing 105, there is a lifter plate 110 (111) for stacking the sheets S. To a side of the lifter plate 110 (111), a slide member 112 is mounted to permit sliding in the casing 105. To the side of the lifter plate 110 (111), four wire fixing elements 113, 115, 116 and 117 are fixedly mounted. They project out through slits 119 formed in the side wall of the bottom casing 106.

To the right bottom part of the casing 105, a wire shaft 120 is rotatably mounted. To such an end (top end in FIG. 7) as is extended through the casing 105, a sprocket 121 and a pulley 122 are fixedly mounted. To the other end, pulleys 122 and 123 are fixedly mounted. To the rear side plate of the casing 105, a lifter driving motor 125 is fixedly mounted by a bracket. The sprocket fixedly mounted on the output shaft thereof is operatively connected with the sprocket 121 by a chain.

As will be described hereinafter, one ends of two wires 129 and 130 are engaged and wrapped around the pulley 122. To the upper parts of the front and rear sides of the lifter plate 110 (111), pairs of guide pulley 131 and 132, are rotatably supported. One 129 of the wires extended from the pulley 122 is fixed to the wire fixing element 113 through guide pulleys 131 and 132, and the other wire 130 is fixed to the wire fixing element 111 through the guide pulley 131.

The fixing method for the wires 129 and 130 is, as shown in FIG. 8, such that ends of the wires 129 and 130 are wrapped around the bottom sides of the wire fixing element 113 and 115, and are fixed by screws at the opposite sides, by which the vertical stroke of the lifter plate 110 (111) becomes maximum. Theoretically, the lifter 110 (111) can be vertically moved through a distance h (FIG. 8), if the slit 119 is properly expanded.

The lowering wire 133 wrapped around the pulley 123 and fixed thereto at its end is fixed, at the other end thereof, to the center of the backside of the bottom casing 106 through a guide bush ring 135. The wrapping direction of the wires 129 and 130 and the wrapping direction of the lowering wire 133 are opposite around the associated pulleys. By the rotation of the wire shaft 120 in the opposite directions, the lifter 110 (111) is vertically movable.

The similar wires 129 and 130 and guide pulleys 131 and 132 are mounted on the rear side plate of the bottom casing 106, and the other ends of the wires 129 and 130 are wrapped around the pulley 122 and fixed thereto.

Thus, the lifter 110 (111) is lifted by the four wires 129 and 130, and the center thereof is lowered by the two lowering wires 133. Therefore, the vertical stroke of the lifter 110 (111) can be made larger than in the lifter drive as disclosed in Japanese Laid-Open Patent Application No. 127934/1988 in which wire is trained in the form of "8". For this reason, a larger amount of sheets can be stacked in the same space.

To the bottom casing 106, there are mounted a friction plate 136 for preventing double feed of final sheets and a sheet absent sensor 137 for detecting the presence or absence of the sheet S on the bottom of the bottom casing 106. Through a hole formed in the bottom casing 106, a guide plate 139 is extended to limit the rear part of the sheet S (lateral direction). It is adjustable in its position within a range indicated by a double head arrows 141. Through another hole formed in the bottom casing 106, a guide plate 140 is extended to limit a trailing edge of the sheet S. The guide plate 140 is adjustable in its position within a range indicated by a double head arrow 142 to accept the sheet having the middle size (B4). When the sheets S have A3 or LDR size (11"×17"), it is shifted to the position indicated by a reference numeral 143.

In FIG. 7, reference numerals 145 and 146 designate a rail and a rail guiding rollers, respectively. To the rear side of the bottom casing 106, a locking roller 147 is mounted, which will be described hereinafter in conjunction with FIG. 14. The locking roller 147 functions to lock the upper/middle decks 43 and 45 in the drawing direction. To the front side of the bottom casing 106, there is mounted a cylindrical panel extension 149 to match the front panels 60 and 61 with the main assembly 41 of the copying machine.

To the end 150 of the wire shaft 120, a wire 151 is wrapped. The end of the wire 151 is operatively coupled with a driver for the remainder displays 67 and 69 shown in FIG. 2, so that the vertical position of the lifter plate 110 (111), that is, the remainder of the sheets S is shown on the display 67 and 69.

Figure 9:
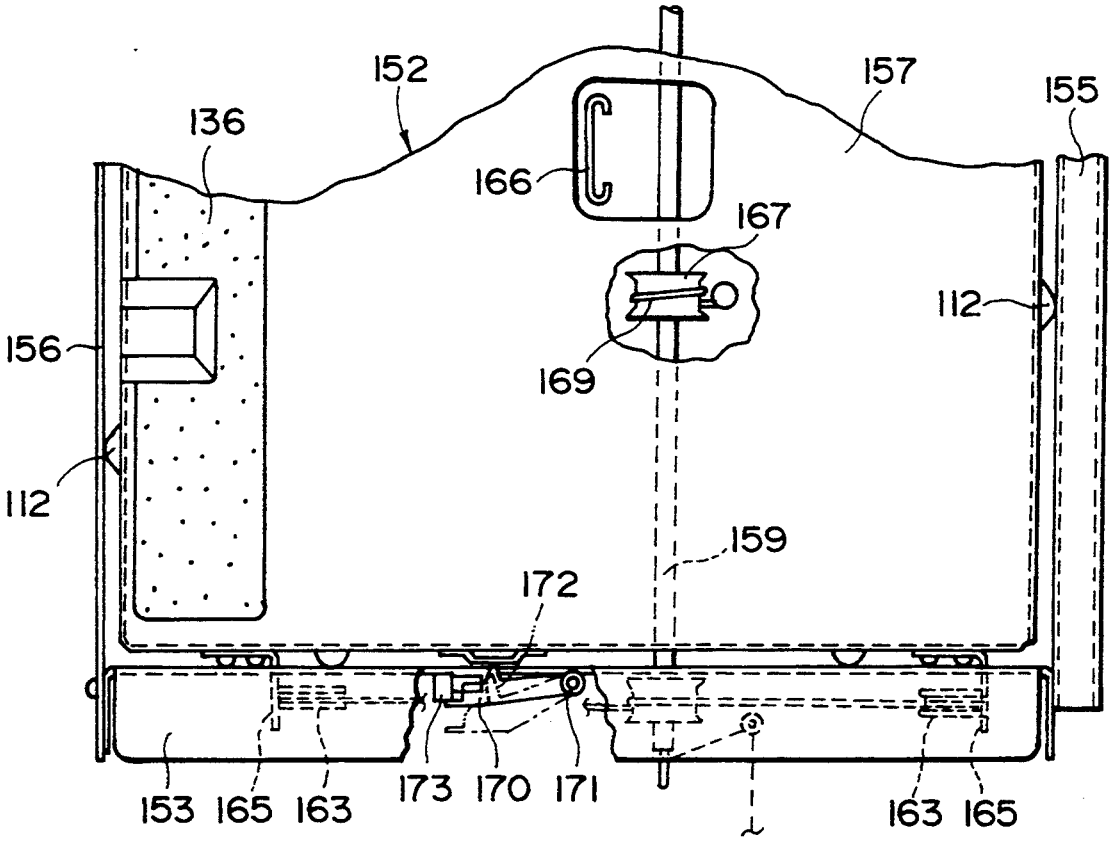
FIG. 9 is a top plan view of a lower deck.
Figure 10:
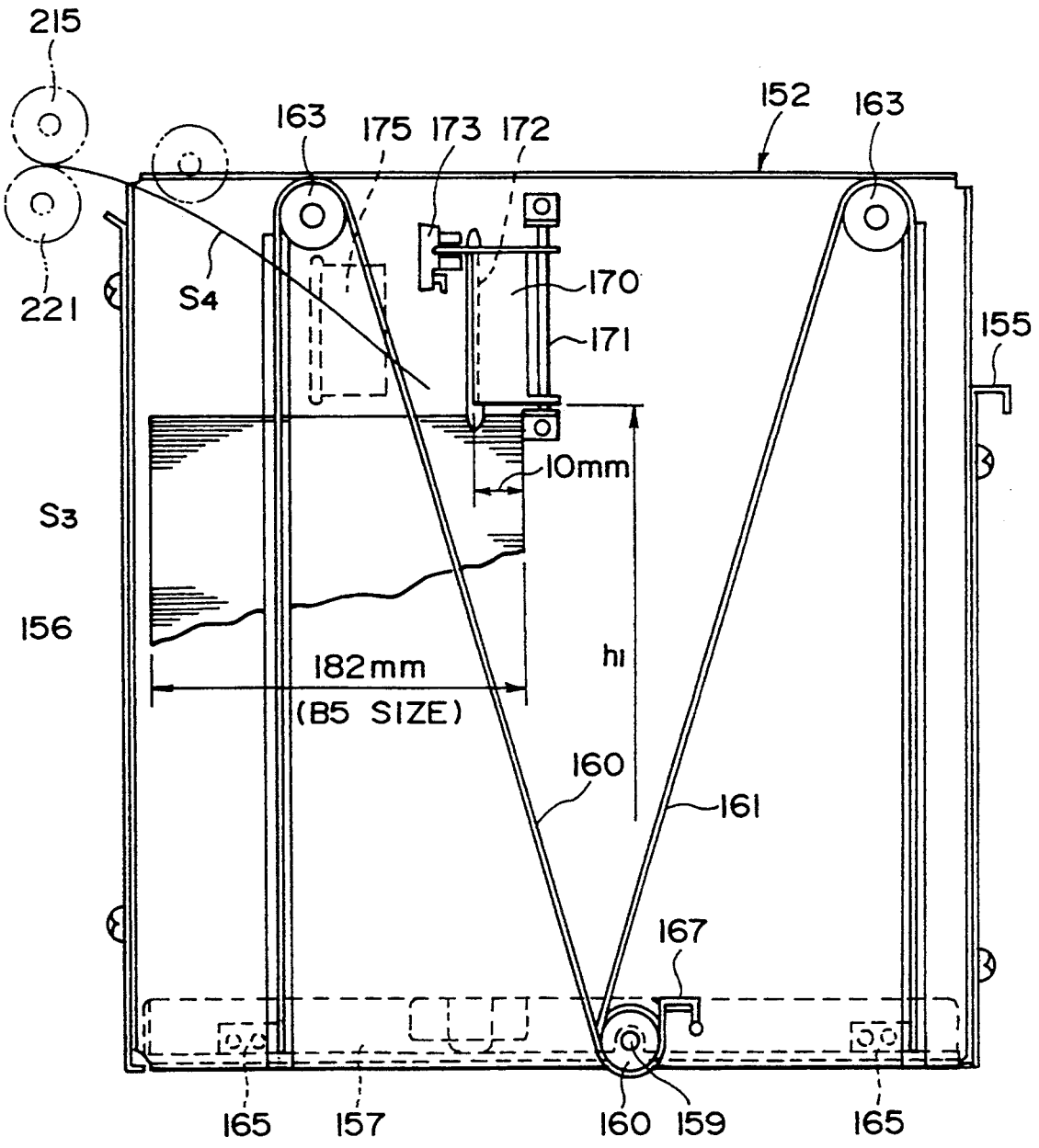
FIG. 10 is a front view thereof.

Referring to FIGS. 9 and 10, a description will be provided as to the lower unit 5. The lower unit 5 fundamentally has the structure obtained by vertically expanding the upper/middle decks 43 and 45. Therefore, a description of the corresponding elements will be omitted for simplicity. A casing 152 of the lower unit 5 has a bottom casing 153, right plate 155 and a left plate 156 and the like, similar to the upper/middle decks 110 (111).

To the bottom center of the bottom casing 153, a wire shaft 159 is rotatably mounted. To the opposite ends thereof, lifting pulleys 106 similar to the pulleys 122 are fixedly mounted. The two wires 161 and 162 having end portions fixed to the pulley 160 are trained around the guide pulleys 163 rotatably supported on the upper portion of the bottom casing 153 and are fixed to respective wire fixing element 165 which are fixedly mounted on the lower lifter 157. The same supporting structure is provided at the rear side of the lower lifter 157.

A wire 169 is trained around a lowering pulley 167 fixedly mounted to the middle of the wire shaft 159, and the other end thereof is fixed to the lower lifter 157. Through a hole formed in the lower lifter 157, a guide member 166 is extended to limit the trailing edge of the sheets S3. By an unshown wire trained around the wire shaft 159, the remainder display 70 shown in FIG. 2 is interrelatedly driven. The wire shaft 159 is rotatable in the opposite directions by an unshown motor.

A description will be provided with respect to a one package sensor peculiar to the lower deck 6. In the sheet feeding apparatus of this embodiment, the manual feeding station 42, the upper/middle deck 43 and 45 (1000 sheets) and a lower deck 6 (3000 sheets) are vertically arranged in this order from the top. The reason why the 1000 sheet deck is not disposed at the bottom is as follows. If the relatively smaller capacity deck is disposed close to the floor 75, the operator is required to squat down when the sheets S are to be replenished. Therefore, the operativity is lowered.

However, if the maximum capacity deck (3000 sheets) is disposed at the bottom, the grip therefor for drawing it out can be disposed away from the floor 75, and therefore, some advantage is provided. If, however, the lower lifter 157 is lowered to the bottom position in order to permit the supply of the sheet, the operator is still required to squat.

In the sheet feeding apparatus 2 of this embodiment, a sensor is provided to the bottom deck 6 only, to permit the lowering of the top surface of the sheets S3 on the bottom lifter 157 only through a predetermined amount even when the lower deck 6 is drawn out to supply the sheets S. The sensor is used separately from the bottom limit sensor for the lower lifter 157. In this embodiment, the predetermined amount for the sheets S3 is 60 mm away downwardly from the sheet feeding position. This is because one package of upper class copy sheets usually contains 500 sheets, and the thickness of the package is approximately 50 mm.

With this structure, the sheet supply surface is always at the position away from the floor 75, and therefore, the sheet S3 can be supplied without the necessity of squatting. In addition, after the operator supplies the sheets S3 and then push the lower deck 6 and lift the lower lifter 157 to lift the topmost sheet S3 to the supply level, it is always within 60 mm, and therefore, quick sheet replenishment is possible.

As compared with the conventional deck in which the lower lifter 157 is lowered to the bottom, the moving distance is one sixth thereof, and therefore, the lowering period of the lower lifter 157 due to the absence of the sheet decreases, and the operativity is increased. In addition, the moving speed of the lower lifter 157 can be decreased as compared with the conventional structure, and therefore, the capacity of the lifting and lowering motor can be reduced.

Referring to FIGS. 9 and 10, a one package sensor will be described. In FIG. 10, to the front side plate of the bottom casing 153, a sensor lever 170 which is long in the vertical direction is rotatably mounted about a shaft 171 and is urged toward the sheet S3 by an unshown spring. A projection 172 formed at a free end of the sensor lever 170 penetrates through a hole of the side plate to extend toward the lower lifter 157. When the sheet S3 or the lower lifter 157 is at a level higher than the height $h_1$, the sheets S3 or the lower lifter 157 urges its to a retracted position (a position away from the side plate). To the side plate, a sensor 173 comprising a photointerruptor is fixed and is rendered on and off by the projection 172 of the sensor lever. When the topmost surface of the sheets S3 reaches the height $h_1$ or becomes lower than that by which the projection 172 is away from the sheets S3 or the lower lifter 157, the sensor lever 170 rotates toward the lower lifter 157 (inside) to actuate the photointerruptor 173.

When the lower deck 6 is drawn out for the purpose of supplying the sheets, the lifting and lowering motor can be controlled so that the height of the topmost surface of the sheets S3 is always at the level $h_1$ by the signal indicative of the actuation of the photointerruptor 173, when the lower deck 6 is drawn out for the purpose of supplying the sheets. However, if the motor lowers immediately upon the sheets being supplied, it will surprise the operator. In consideration of this, even if the topmost surface of the sheets is increased by the height of the one package of the sheets by the supply, the motor is not immediately actuated, but it is operated with the delay of 1–3 sec.

More particularly, it is only after the sensor lever 170 continues to be pressed down by the sheets S3 for 1–3 sec or longer by the supply of the sheets S3 that the motor is rotated to lower the lower lifter 157 to continue to lower it until the signal of the sensor 173 changes.

By repeating this, the level of the topmost surface of the sheets S3 can be maintained at the level $h_1$ until the lower lifter 157 reaches the bottommost position. After the lower lifter 157 lowers to the bottommost position, the motor is not rotated. After this state is reached, if the sheets are supplied more, the level of the topmost sheet is higher than the level $h_1$.

The vertically long sensor lever 170 is disposed adjacent a trailing end with respect to a sheet feed direction of the sheets having the size which can be fed from the lower deck. In the lower deck 6 of the feeding apparatus of this embodiment, the minimum size is B5, and therefore, it is disposed 10 mm away from the trailing edge of a B5 size sheet. This is done, because if there is a sheet S4 having a leading edge gripped by separation rollers 215 and 221 which will be described hereinafter, the sheet S4 bears on the lower unit, when the lower lifter 157 is lowers. At this time, if the sensor lever 170 is at the position indicated by a reference numeral 175, it detects the sheet S4, and therefore, the signal of the sensor 173 does not change however the lower lifter 157 is lowered. In order to prevent such a malfunction, the sensor lever 170 is disposed as rearward as possible. However, this is limited by the minimum size. For the reasons, the position of the sensor lever 170 is quite limited.

Figure 11:
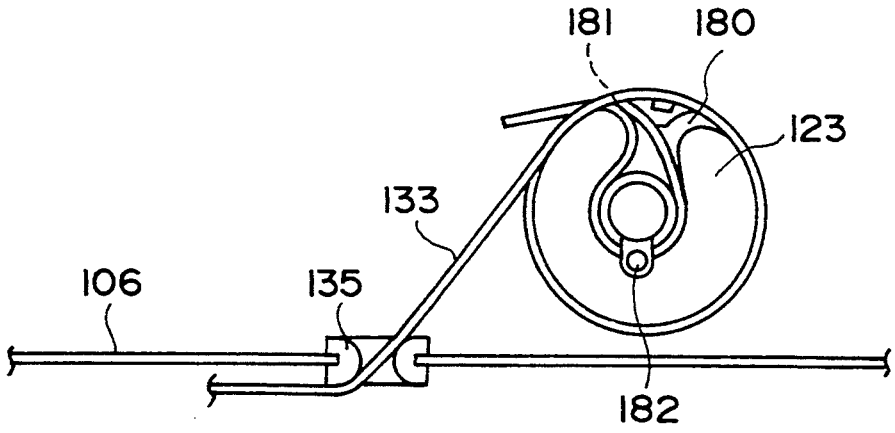
FIGS. 11, 12 and 13 show details of a wire pulley.
Figure 12:
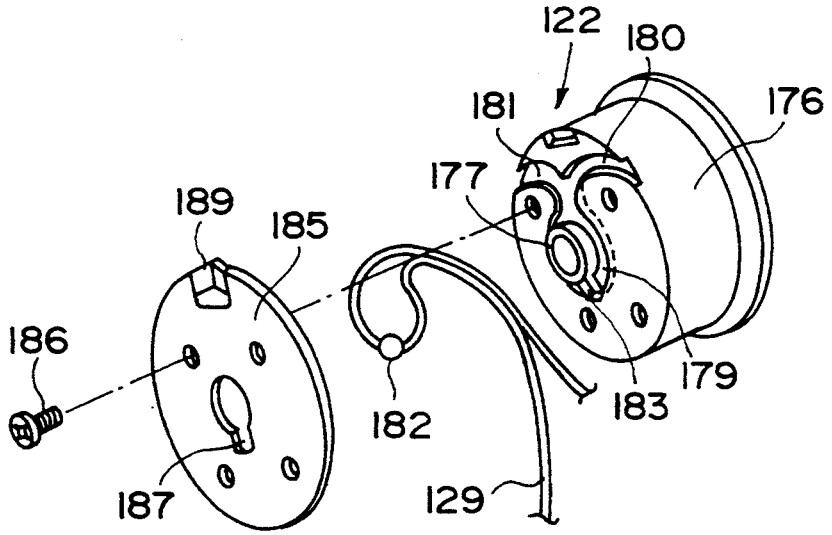
Figure 13:
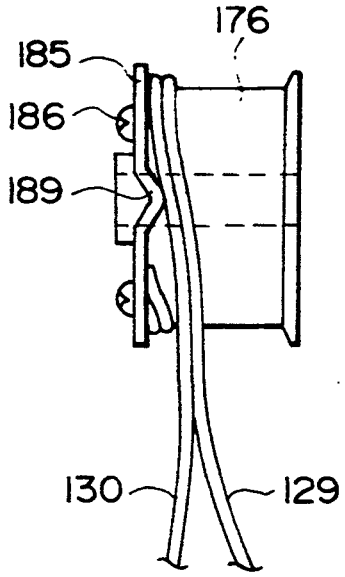

Referring to FIGS. 11, 12 and 13, a description will be provided as to the pulley 122 (FIG. 7). In FIG. 12, an end surface of the pulley 176 is provided with a groove 179 formed around a boss 177 and two grooves 180 and 181 branched out of the groove 179. Each of the grooves 180 and 181 has depth l which is substantially the same as the diameter of the wire. The groove 180 is used when the wire is trained in the clockwise direction, and the groove 188 is used for the reverse direction. The wires 129 and 130 are connected to an inside of the pulley 122 and constitute a length of wire, and is divided into two parts by a ball 182 having a hole and clamped on the wire.

The ball 182 is engaged and fixed in a recess 183 formed at a middle part of the groove 179 of the pulley 176. The flange 185 and the pulley 176 sandwich the wires 129 and 130, and the flange 185 is fixed by screws 186, by which the wires 129 and 130 are fixed. The flange 185 is provided with a cut-away portion 187 engageable with the ball 182. By fixing the wire portions 129 and 130 of the one length of wire, the force which is a difference between the tension forces applied to the wire portion 129 and the wire portion 130, is applied to the ball 182. Therefore, the wire end can be more stably fixed than when it is fixed simply by clamping an end thereof. In addition, the wires 129 and 130 are free from a significant bending, and therefore, the wires 129 and 130 can be stably trained.

The flange 185 is provided with a position 189 extending toward the main body 176 of the pulley. The projection 189, when the wires 129 and 130 are trained one turn, is effective to prevent double training on the previously trained wires 129 and 130. FIG. 13 shows the prevention of the double training. The height of the projection 189 is approximately 1.5 times the diameter of the wires 129 and 130.

Figure 14:
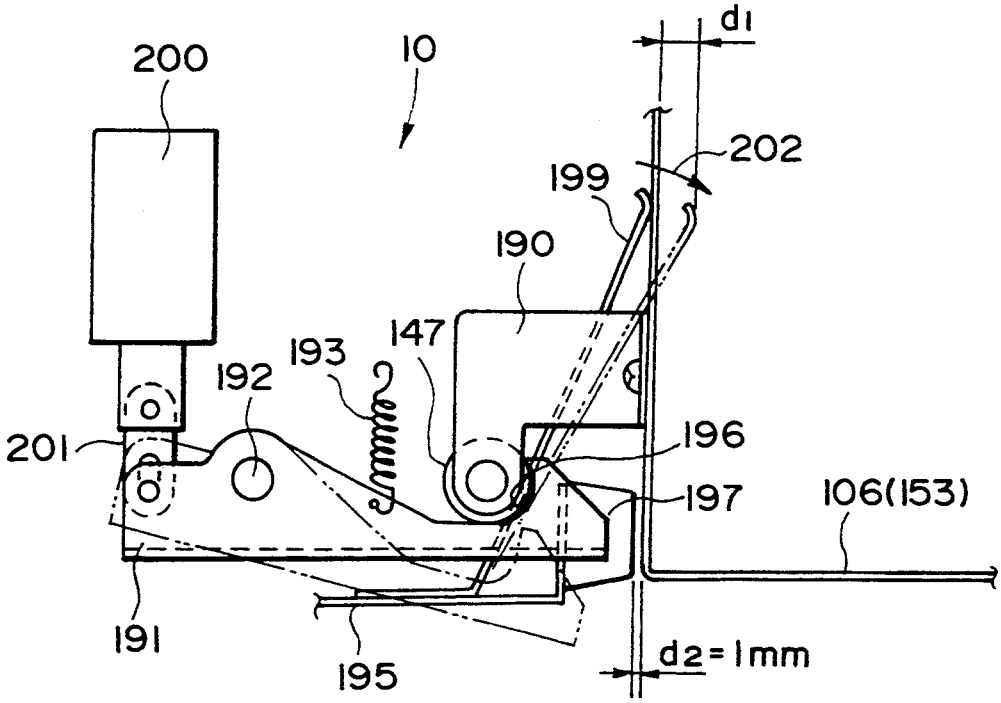
FIG. 14 is a top plan view of a locking unit for the upper/middle/lower deck.

FIG. 14 shows a looking unit for locking the upper/-middle and lower decks 43, 45 and 5, and such locking units are provided for the respective decks.

In this figure, the rear side plate of the bottom casing 106 of each of the decks, is provided with a bracket 190 fixedly mounted thereto. It supports the locking roller 147 (FIG. 7). To the frame 3A of the upper unit 3, a supporting member 195 is fixedly mounted. The supporting member 194 has a locking pawl 191 rotatably mounted thereto by a shaft 192. By a resilient force of a tension spring 193 having an end engaged to the frame 3*a*, it is urged in the counterclockwise direction. The pawl 196 of the locking pawl 191 is formed into a circular form about a center coincident with the shaft 192. The pawl 196, when the upper and lower decks 43 and 45 are pushed and set, is brought into engagement with the locking roller 147 to prohibit the upper and middle decks 43 and 45 from being drawn out.

The supporting member 195 of the frame 3*a* is provided with a stopper 197 made of rubber mounted thereto. It functions as a stopper when the upper/middle deck 43, 45 is pushed. To the supporting member 195, a base of a leaf spring 199 is fixedly mounted. The leaf spring 199 functions to push the upper/middle deck 43 or 45 back toward the front. By doing so, the locking roller 147 and the pawl 196 of the locking pawl 191 are always in contact to correctly position the upper and middle decks 43 and 45 in the drawing-out direction.

The solenoid 200 fixed on the frame 3*a* is connected with a trailing side end of the locking pawl 191 through a lever 201. When the solenoid 200 is actuated, the locking pawl 191 is rotated to the position indicated by chain lines, and the leaf spring 199 displaces in the direction of arrow 202 through a distance d1. To retract slightly the upper/middle deck 43, 45, by which the locking by the locking pawl 191 is released. The solenoid 200 is deenergized upon a deck drawing sensor (not shown) detects the retraction of the upper/middle deck 43, 45.

The locking unit 10 is constituted by the locking pawl 191, the locking roller 147 and the solenoid 200 and the light. The bottom deck 6 is locked by a locking unit 10 having a structure that for the upper/middle deck 43, 45.

The locking unit 10 described in the foregoing is fixedly mounted on the frame 3A, 5A by screws. However, it is adjustable in the direction of the drawing-out of the upper/middle or lower deck 43, 45 or 6. Therefore, the lateral registration adjustment is possible for the sheets S. The stopper 197 and the leaf spring 199 are movable together with the shaft 192, and therefore, the distance d1 described above and the distance d2 between the stopper 197 and the side plate of the bottom casing 106 (153) are maintained constant. In this embodiment, the distance d2 is 1 mm.

The locking unit 10 has an unshown sensor switch to detect whether the upper/middle deck 43, 45 or 6 is drawn out or locked.

Therefore, the prevention of simultaneously drawing-out of the upper/middle deck 43, 45 and 6, is electrically carried out. More particularly, any one of the upper, middle decks 43, 45 and 6 is drawn out, the other deck can not be drawn out even if the switch 71 (FIG. 2) is depressed.

Figure 15:
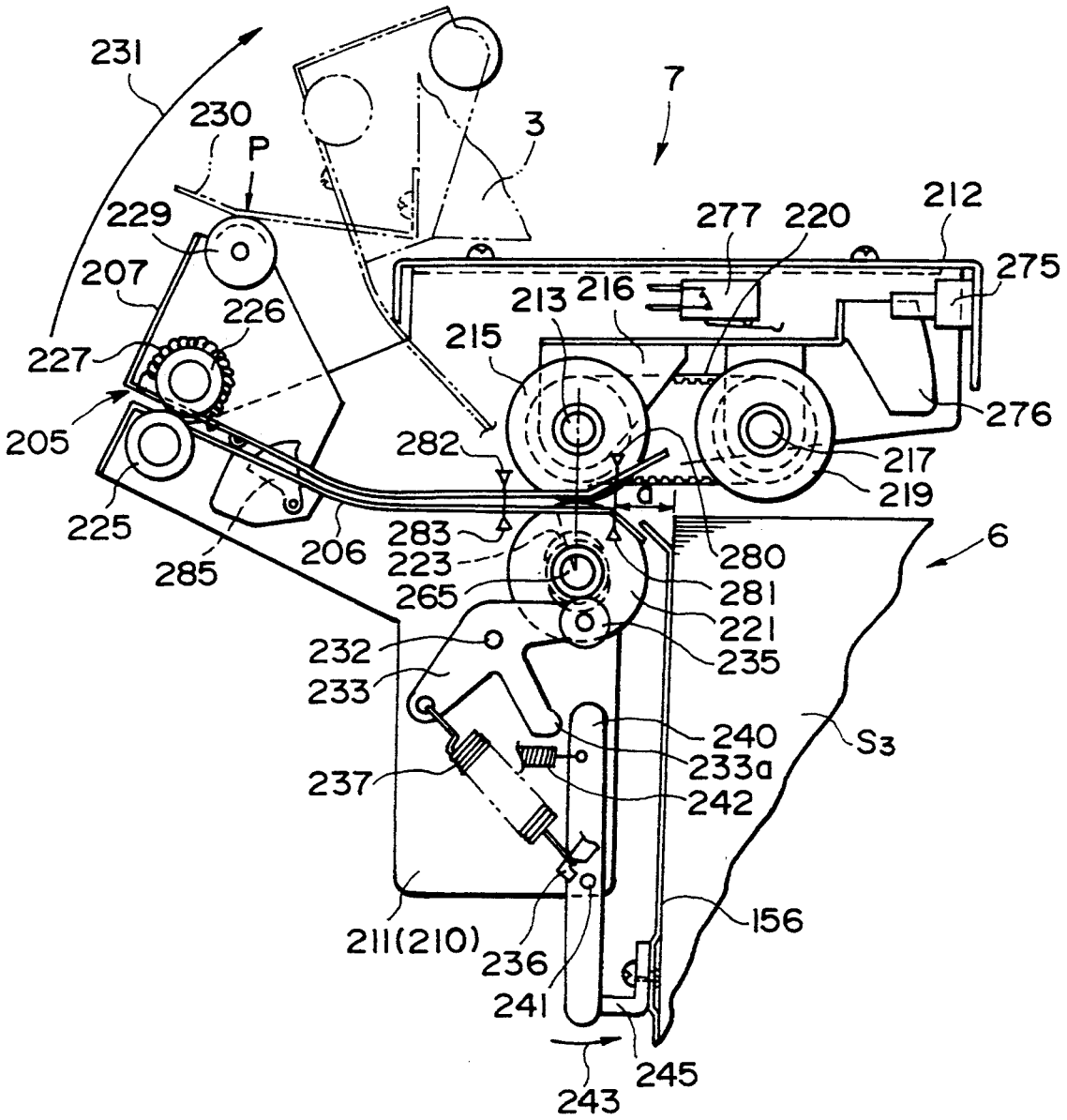
FIG. 15 is a longitudinal sectional view of a lower sheet feeding unit.
Figure 16:
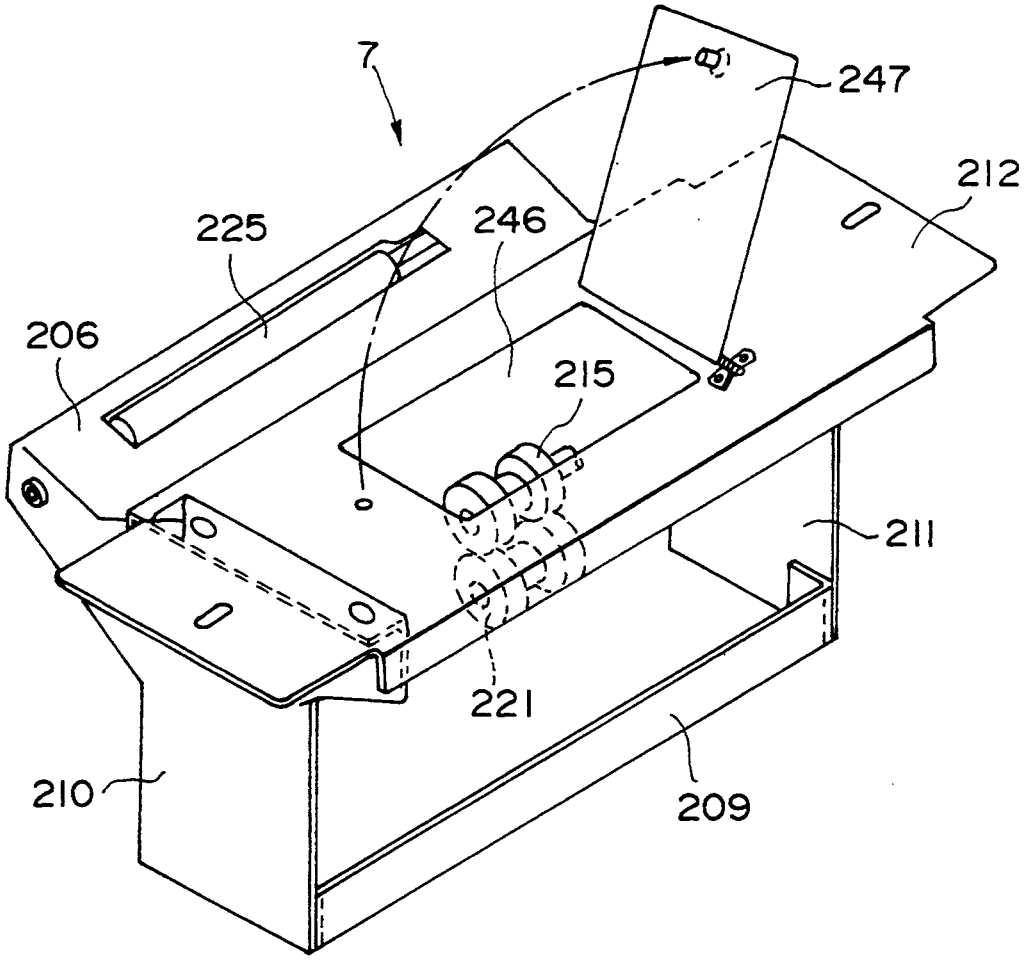
FIG. 16 is a perspective view thereof.

Referring to FIGS. 15, 16, 17 and 18, a description will be provided as to the lower sheet feeding unit 7. In FIGS. 15 and 16, the lower sheet feeding unit 7 has a fixed sheet guide 206 and a movable sheet guide 207 which constitute a conveyance passage 205 for the sheets S3 supplied from the lower deck 6. The fixed sheet guide 206 is fixed to the upper portions of the frames 210 and 211 which are connected at the bottoms by a connecting plate 209. The movable guide 207 is rotatably mounted at its base portion around a shaft 213 mounted on the base 212.

To the shaft 213, a feed roller 215 is mounted through an unshown one way clutch. To the pick-up arm 216 rotatably mounted at its base portion on the shaft 213, a shaft 217 is rotatably mounted. To the shaft 217, a pick-up roller 219 is mounted through an unshown one way clutch. The pulleys fixedly mounted on the respective shafts 213 and 217 are operatively coupled by a belt 220. The lower sheet feeding unit 7 has a dedicated motor (not shown). The shaft 213 is driven by the motor through an unshown electromagnetic clutch.

Figure 18:
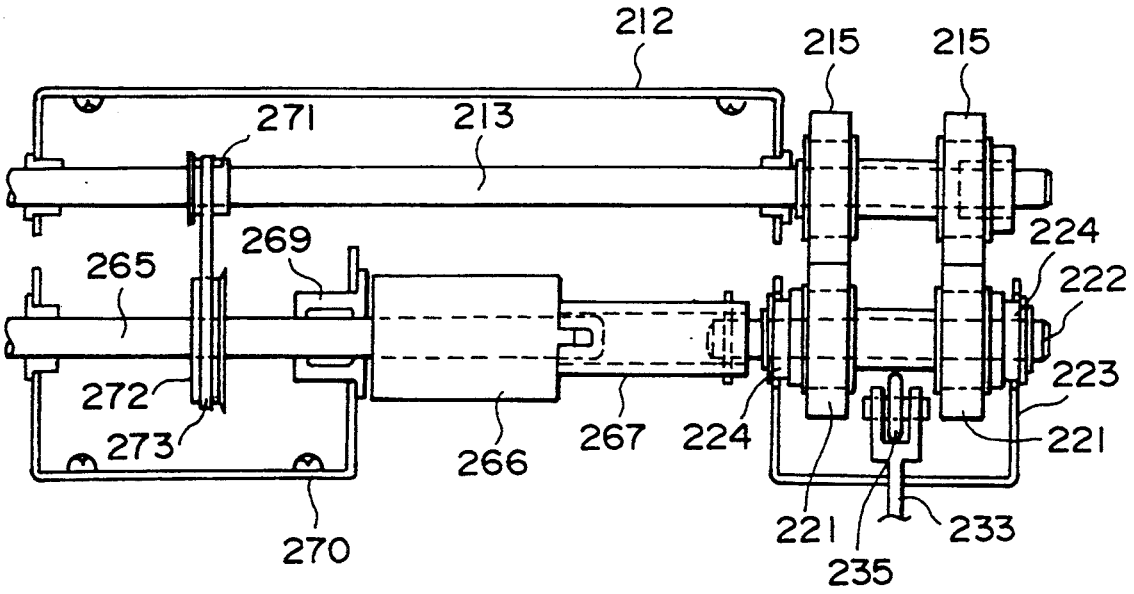
FIG. 18 is a top plan view of a retarding separator.

A retarding roller 221 contacting the feed roller 215 functions to push back one or more of the double-fed sheets S3, and is fixedly mounted on the shaft 222 shown in FIG. 18. It is rotatably mounted on a supporting member 223 by a bearing 224. The bearing 224 is slidable in a groove 223*a* of the supporting member 223, and is movable toward and away from the feeding roller 215. The groove 223*a*, as shown in FIG. 15, is inclined at a predetermined angle (10 degrees in this embodiment) relative to a line connecting the roller 215 and the roller 221. This is done in order to increase the pressure between the feed roller 215 and the returning roller 221 when the returning roller 221 is driven, by which the sheet feeding operation is stabilized.

A roller 225 disposed downstream of the retarding roller 221 is rotatably supported on the frames 110 and 111, and is directly driven by a motor. An idle roller 226 press-contacted to the roller 225 is mounted in an elongated slot formed in the movable sheet guide 207, and is urged toward the roller 225 by a spring 227.

The movable sheet guide 207 is provided with a roller 229, and is urged in a direction P by a leaf spring 230 mounted on the upper unit 3. Upon the occurrence of a jam in connection with the sheet S3, the upper unit 3 is slid in the drawing-out direction, by which the movable sheet guide 207 becomes capable of rotating in a direction indicated by an arrow 231 to the chain line position, and therefore, the movable sheet guide 207 is automatically released. This facilitates a jam clearance operation.

In FIGS. 15 and 18, a pressing arm 233 having three arms supported by the shaft 232 has an end having a rotatable roller 235. The roller 235 urges the shaft 222 by a tension spring 237 engaged with the pressing arm 233 and the engaging member 236 at the opposite ends thereof, so as to press the retarding roller 221 to the feeding roller 215.

A releasing lever 240 is rotatably mounted about a shaft 241 on the lower sheet feeding unit 7. One end thereof is urged in a direction indicated by an arrow 243 by the resilient force of a tension spring 242 locked on an unshown fixed member. The releasing lever 240 is limited in its rotation by abutment of its lower end to a pressing member 245 fixedly mounted on a left side plate 156 of the lower deck 6.

The tension spring 242 has a stronger spring force than the tension spring 237. When the lower deck 6 is slid in the drawing-out direction, the releasing lever 240 rotates in the direction of an arrow 243, so as to urge and rotate an end 233*a* of the pressing arm 233 to release the pressure by the roller 235. The pressing arm 233, the releasing lever 240 and the like constitute a releasing mechanism 11 to release the urging by the retarding roller 221. Upon the performing of the releasing operation, the lower deck 6 is drawn out, and then, the pressure by the retarding roller 221 is automatically released, thus facilitating the jam clearance operation.

Although not shown in the figure, a separate releasing lever is used corresponding to the releasing lever 240 to release the pressing arm 233 by sliding movement of the upper unit 3 in the drawing-out direction. By doing so, the jam clearance is made even easier.

The nip formed between the feeding roller 215 and the returning roller 221 is disposed in an inside opening of the frame 3a, and the retarding roller 221 is released upon the drawing-out of the lower deck 6, and therefore, the sheet S3 can be taken out without damage thereto. In FIG. 16, the lower sheet feeding unit is detachably mounted on the lower unit 5 by a base 212. The feed roller 215 is composed of a consumable material, and therefore, is required to be replaced at regular intervals. Therefore, an easy replacement operation is desired.

The base 212 is provided with an opening 246, which is closed or opened by rotation of a cover 247. When the cover 247 is opened, the feed roller 215 is accessible for replacement. The retarding roller 221 is disposed at the lower portion of the fixed sheet guide 206, and therefore, it is not possible to replace it from the upper side. The returning roller 221 is in the form of a cartridge type unit. After the lower deck 6 is drawn out, the cartridge can be mounted or dismounted from the lower deck 6 side.

Figure 17:
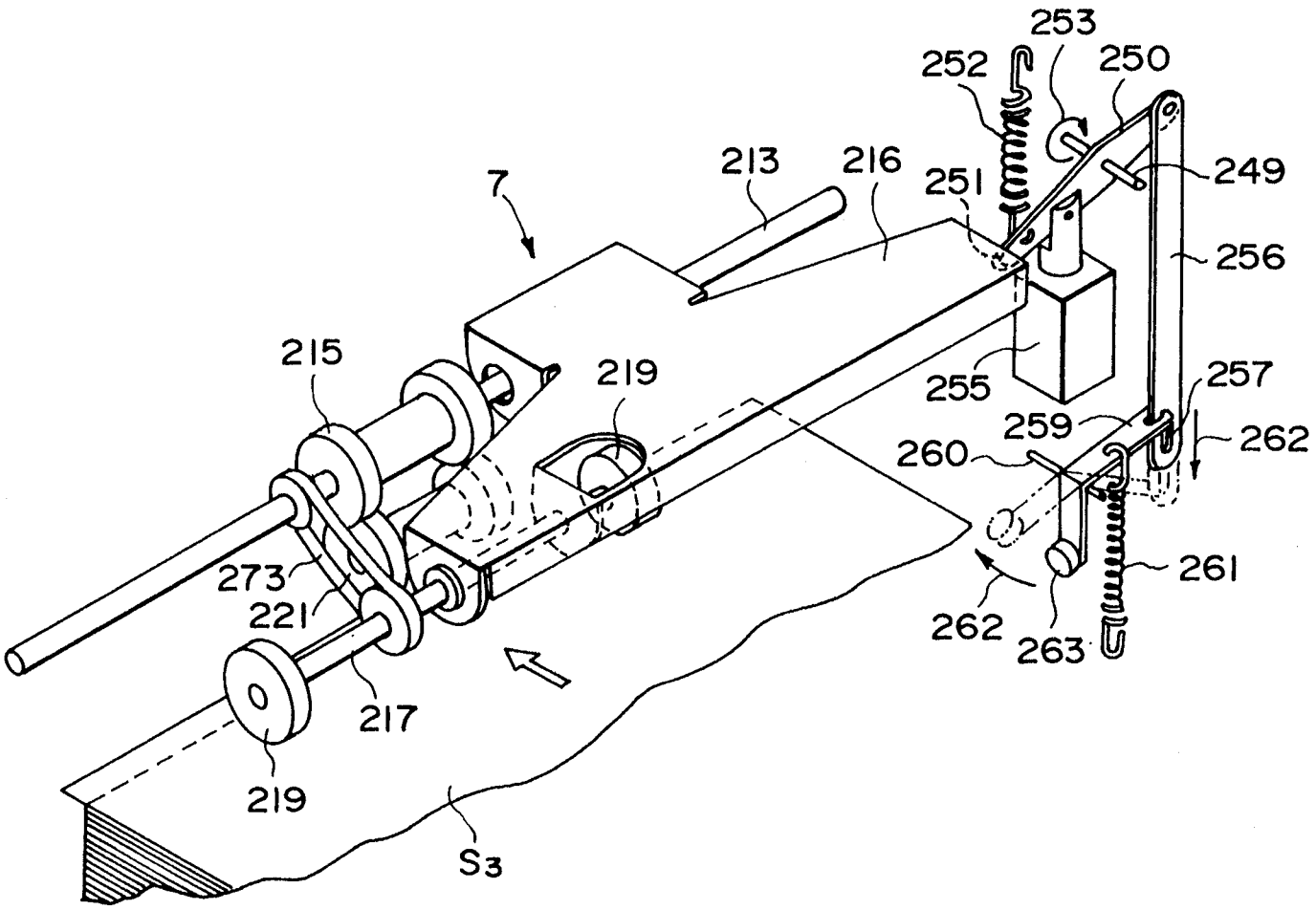
FIG. 17 is a perspective view of a pickup roller.

The pickup roller 219 is durable against the processing of 1,000,000 sheets. Therefore, only the roller 219 is replaceable when the lower unit 5 is entirely detached. FIG. 17 is a perspective view of the pickup roller 219, the feeding roller 215 and the retarding roller 221 of the lower sheet feeding unit 7.

The copying machine 1 of this embodiment is capable of producing 90 copies per minutes in the mode wherein the original is fixed and read in association with the original processing device 47. However, in a mode in which one set of copies is produced from one set of originals (one-to-one), the originals are fed out from a tray exclusively for the reading scanner, and the copy is scanningly read with the optical system 51 of the main assembly 41 being fixed.

By doing so, the waste of time during the returning of the optical system 51 can be eliminated, so that the speed of the flash exposure and the copy operation can be increased. The number (90) of the sheets which can be processed per minute can be increased to 120 sheets. However, in this case, the sheet intervals becomes quite small despite the sheet feeding speed being unchanged. Therefore, it places quite severe burden on the sheet feeding apparatus.

In the sheet feeding apparatus of this embodiment, a sheet interval of not more than 40 mm is achieved with a sheet feeding speed of 500 mm/sec. It will be understood that the sheet interval corresponds to 0.08 sec (40/500). Then, it would not be possible to lower and lift the pickup roller 219 in consideration of the occurrence of bounding of the pickup roller 219 by abutment between the roller 219 and the sheet S3.

If, however, the pickup roller 219 is maintained in press-contact on the sheets S3 in the returning roller type, the prevention of a double feed is not sufficient which makes it easy for double feeding of the sheets S3 to occur. In order to solve the above problems, in this embodiment, the pickup roller 219 of the lower unit 5 is of a type in which sheet feeding pressure is changeable.

In FIG. 17, the pickup roller 219 is mounted on the pickup arm 216 rotatably supported on the shaft 213. An end portion 251 of the swingable arm 250 supported on the shaft 249 is disposed at a backside of an end portion of the pickup arm 216. The swingable arm 250 is urged in a direction of an arrow 253, that is, in the direction of lifting the pickup arm 216, by a spring force of a tension spring 252 having an end engaged to a fixed member. The swingable arm 250 is connected with a solenoid 255 capable of applying a force in the direction opposite from that of the tension spring 252.

To the other end portion of the swingable arm 250, an upper end portion of the link 256 is rotatably mounted. With the elongated slot 257 formed in the link 256 adjacent its bottom end, an end portion of a horizontal portion of an "L"-shaped abutment member 259. An operating member 259 rotatably supported on a shaft 260 is urged in a direction of an arrow 262 by a tension spring 261. To a bottom portion of the arm extending in the longitudinal direction of the operating member 259, an abutment member 263 is fixedly mounted.

When the solenoid 255 is deenergized, the pickup arm 216 is lifted by the tension spring 252. In the case of a conventional pickup roller, the length of the tension spring 252 is as high as the pickup roller 219 is away from the sheet S3. However, in this embodiment, the strength of the spring 252 is such that the pickup roller 219 is in contact with the sheet S3 with a contact pressure of not more than 50 g (reduced pressure) although normally it is press-contacted to the sheet S3 with the pressure of approximately 120 g.

Accordingly, the rebound of the pickup roller 219 relative to the sheet S3 is avoided, and therefore, the pickup roller 219 can repeat pressing and releasing actions substantially in response to the actions of the solenoid 255. When the solenoid 255 is energized, the pressure is approximately 120 g, and when it is deenergized, it is not more than 50 g, on the sheet S3.

When the lower deck 6 is drawn out, the link 256 and the operating member 259 and the like are effective to lift up the pickup roller 219. When the lower deck 6 is in place, the abutment member 263 of the operating member 259 is pressed by the lower deck 6, and disposed at the solid line position against the spring force of the tension spring 261. The link 256 is free within a range of an elongated slot 257.

When the lower deck 6 is pulled out, the operating member 259 is moved to the broken line position by the spring force of the tension spring 261, and therefore, the link 256 is pulled down, so that the swingable arm 250 rotates in the direction 252 to lift up the pickup roller 219.

FIG. 18 is a view of the lower sheet feeding unit 7 as seen in the feeding direction. In this figure, to a torque limiter 266 connected with the shaft 265, a torque transmitting member 267 functioning as a universal joint is connected. To the other end portion of the torque transmitting member 267, the shaft 222 having the retarding roller 221 is connected. A shaft 265 is mounted on the supporting plate 270 through a bearing 269 with a one way clutch. The shaft 265 receives the driving force through an unshown electromagnetic clutch. By the function of the bearing 269 with the one way clutch, even if the shaft 265 is made free by the energization of the electromagnetic clutch, the retarding roller 221 rotates in the opposite direction to prevent the double feed of the sheet S3.

Figure 19:
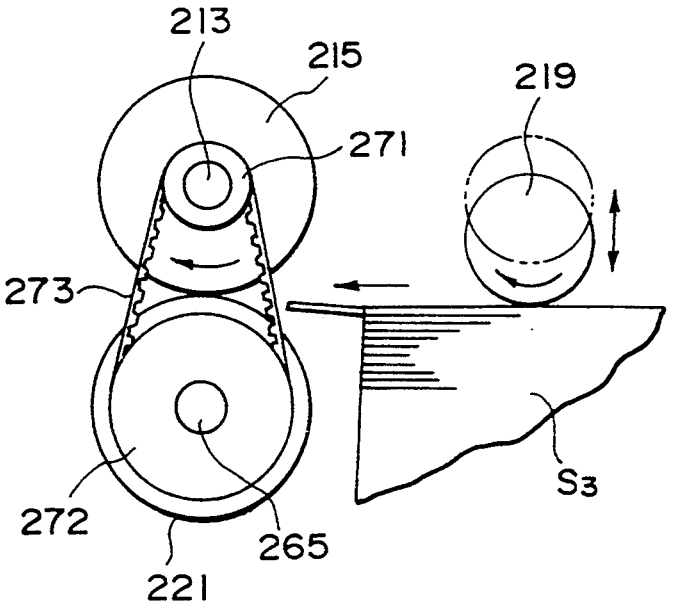
FIG. 19 is a side view thereof.

As shown in FIGS. 18 and 19, to the shaft 213 of the feeding roller 215 and to the shaft 265 connected with the retarding roller 221, pulleys 271 and 272 are respectively fixedly mounted, and the pulleys are operatively connected by the belt 273. In this embodiment, the rotational speed ratio between the pulleys 272 and 271 is approximately 1:2. The reason is as follows. If the tangential or peripheral speed of the retarding roller 221 is made equal to the peripheral speed of the feeding roller 215 and if the sheet feeding speed is increased, the maximum rotational speed of the torque limiter 266 is too large. This can be prevented by the rotational speed ratio described above. The torque limiter 266 discharges the additional torque as heat, and therefore, a high speed rotation is not desirable.

Referring to FIG. 15, sensors will be described. In this figure, in the case 211, a sensor 275 is disposed in order to maintain a predetermined speed feeding level for the sheet S3. By an operating arm 276 fixed to a free end of the pickup arm 216, the motion of the pickup arm 216 is detected to control a lifter motor for the lower deck 6.

The switch 277 fixedly mounted in the base 212 is effective to prevent excursion of the lifter motor, when the microcomputer for controlling the sheet feeding apparatus becomes out of order. It is directly connected with a motor driving line for the lower deck 6. It is in the form of a so-called overrun switch to shut off the power supply to the lifter motor when the lower deck is lifted too much by the lifter motor.

Upstream and downstream of the nip formed by the feeding roller 215 and the retarding roller 221, transparent type sensors 280, 281, 282 and 283 are disposed, comprising light emitting portions and light receiving portions. In this embodiment, it is placed 10 mm upstream and 20 mm downstream of the nip. The reason why the sensor is of a transparent type, is that if they are of usual lever type, the quick response upon the returning action is too low. Sensors 280 and 281 are used to control the sheet feed start position. As shown in FIG. 15, normally, there is a predetermined clearance a between the leading edge of the sheet and the nip between the rollers 215 and 221, when the sheet are stacked. In this embodiment, the distance a is approximately 25 mm.

During the sheet feed, the sheet S3 is separated by the nip, and therefore, the start position of the sheet, that is, the leading end position of the sheet S3 before it is fed, in the range of distance a (25 mm), is not known. This means that the timing of the sheet feed is deviated possibly by a maximum of 25 mm.

In the usual sheet feed with relatively large sheet intervals, the deviation of the timing is not significant. However, if sheet intervals as small as 40 mm is desired, the deviation is quite large. More particularly, a quite large error results by 40 mm$\pm$25 mm$=$15$-$65 mm. In order to minimize the deviation, the sensors 280 and 281 are used.

The operation of the apparatus of this embodiment will now be described.

When the trailing edge of the sheet S fed forward from the lower deck 6 is fed by the nips formed between the rollers 215 and 221, at the instance when it passes through the nip, a discrimination is made by the sensors 280 and 281 as to whether the leading edge of the next sheet S is within the range of a of FIG. 15 or whether it is closer to the nip. If it is closer to the nip beyond the range a, the sheet is fed at the usual timing.

When the next sheet S is in the range a, the pickup roller 219 is rotated through a small distance at the instance when the sheet passes through the nip. By this, the leading edge of the next sheet S is advanced toward the nip beyond the sensors 280 and 281. Thereafter, the sheet is fed at the usual timing. By doing so, the variation in the sheet feed timing can be made smaller than in the conventional sheet feeding system.

Sensors 282 and 283 are sensors for producing the sheet feed timing. They detect the trailing edge of the previous sheet S, and the sheet feeding signal for the next sheet S is produced. With the decrease of the distance between the nip and the sensors 282 and 283, the possible sheet intervals in the sheet feeding decreases. During the prevention of the double feed by the rollers 215 and 221, a double feed occurs slightly through the nip, and thereafter, the additional feed is moved back by the retarding roller 221. Since this can happen, it is not possible to dispose it very closely to the nip, and therefore, it is disposed approximately 20 mm downstream of the nip. Downstream of the sensors 282 and 283, there is a usual lever type sheet sensor 285.

Figure 23:
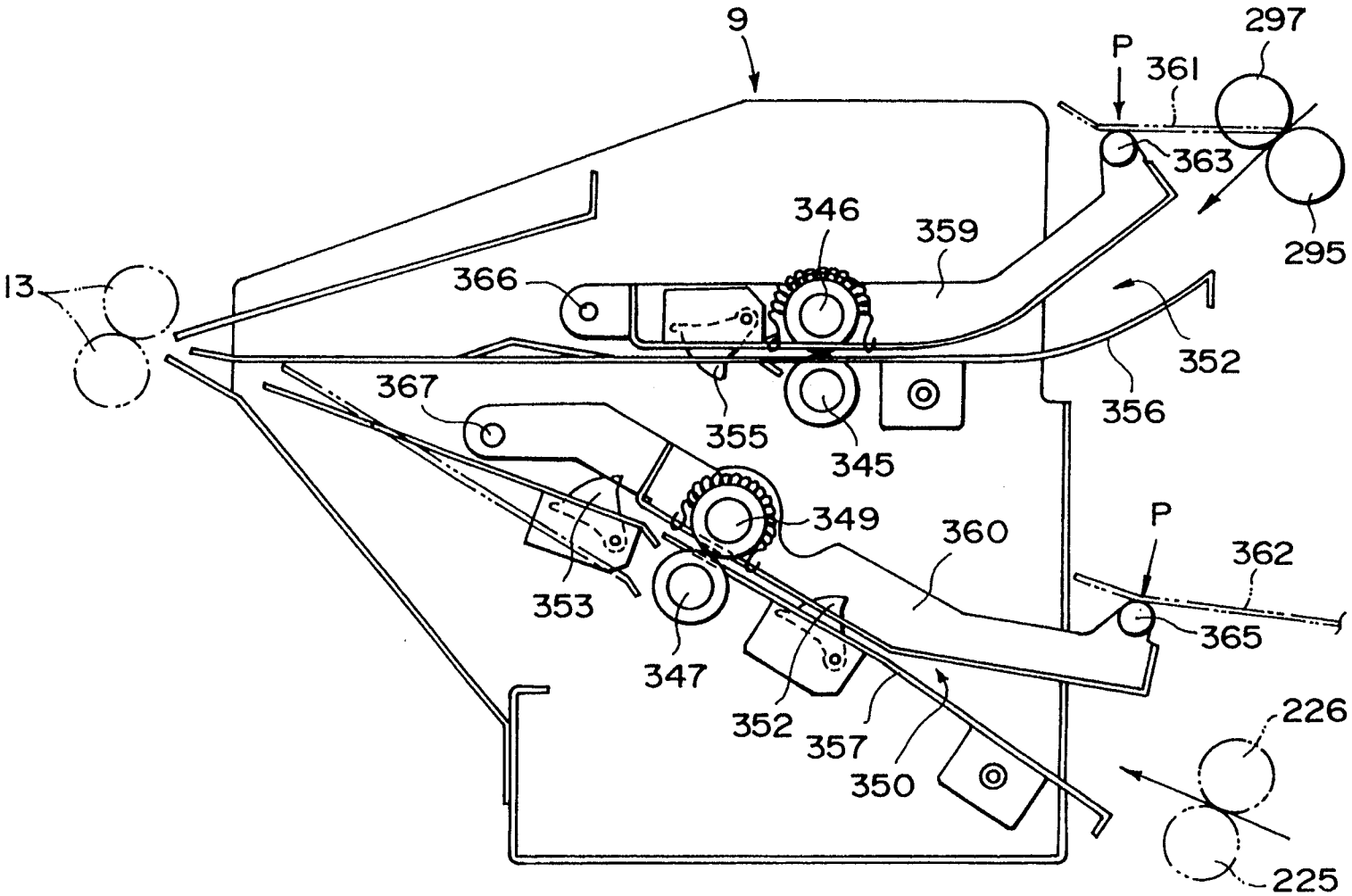
FIG. 23 is a longitudinal view of an interface unit.

Referring to FIGS. 1, 15 and 23, a pre-feed system for the sheets will be described. As shown in FIG. 1, the sheet feeding apparatus 2 of this embodiment stacks the sheets S at a position remote from the registration rollers 13 of the main assembly 41. Usually, the copy operation speed of the copying machine 1 is determined by the scanning speed of the optical system 51. Thus, downstream of the registration roller 13, the maximum copying speed can be obtained when the sheet S is fed in synchronism with the scanning speed of the optical system 51.

However, when a set of originals, the number of which is not known by the copying machine, is fed by an original document feeder 47, it is not possible to know when the original feeder becomes empty. If the sheet feeding apparatus 2 feeds the sheets with the sheet intervals so as to provide the maximum copy speed, trouble occurs, that is, when the "no original" is detected, the next sheet has already been fed out.

Such a sheet is called "flying paper". This easily occurs when the sheet feeding station is remote from the registration rollers 13, as in this embodiment, and easily occurs when the sheet size is such that they are fed with smaller sheet intervals.

In order to solve the problem, it is conventional that the registration rollers 13 are disposed close to the sheet stacking position, or that the sheet feed from the deck is started while confirming the outstanding original for each copies, at the cost of copy speed in the mode in which it is not known when all the originals are copied. In some case, the sheet S once fed out is returned into the deck by the reverse rotation of the roller.

In this embodiment, when the sheets are fed from the lower deck 6, one flying paper sheet deliberately remains between the lower deck 6 and the registration rollers 13, so that the above discussed problems are solved. This sheet feeding system is called pre-feed, hereinafter.

In the pre-feed system, the sheet S always remains in the sheet passage, and therefore, if the sheet S remains in a curved sheet passage, the sheet S is curled with the increased possibility of the improper image transfer operation, sheet jam and/or improper stacking of the sheets in the sorter.

In this embodiment, the sheet passage in the interface unit 9 is divided into two passages, and the sheet passage from the lower deck 6 is made substantially rectilinear (radius of curvature is not less than 100 mm). By doing so, the curling of the pre-fed sheet S is prevented. Since it is difficult to use the substantially rectilinear passage for the upper or middle deck 43 or 45, the pre-feed system is not used in this embodiment. Therefore, the copy speed is lower than that of the lower deck 6.

Another reason for not using the pre-feed in the upper and lower decks 43 and 45, is that when the upper unit 3 is drawn out, the pre-fed sheet S is divided in the sheet passages, and therefore, the sheet is no longer usable, that is, the sheet S is wasted. On the contrary, in the passage for the lower deck, the sheet S is not divided.

In the sheet feeding apparatus 2 of this embodiment, the sizes of the sheets capable of being fed out from the lower deck 6 are A4, B5 and LTR (11"×8.5"). There are some points to be considered in the pre-feeding system. One of them is that the sheet passage is substantially rectilinear as described hereinbefore. Second, the trailing edge of the pre-fed sheet S is downstream of the nip between the rollers 215 and 221.

If, when the operator is going to drawing the lower deck 6 out, the trailing edge of the sheet S pre-fed remains in the lower deck 6, it obstructs the movement of the lower deck 6. In the worst case, the trailing edge portion of the pre-fed sheet is damaged or torn.

In this embodiment, the distance b from the registration rollers 13 to the lower deck 6 is determined in the following manner. In the case of A4, B5 or LTR size, it is not possible to reduce the distance b to such an extent as not to reduce the copy speed, and therefore, the pre-feeding is carried out. In the case of B4 size, the sheet intervals are larger than in the above three cases, and therefore, it is possible to set such a distance b that the copy speed is not reduced even if the sheets are fed after it is confirmed that the originals are outstanding, that is, after the sheet feed signal is received from the main assembly 41.

In this embodiment, the distance b is determined in this manner, and therefore, the pre-feeding is not used for the size B4. In FIG. 1, the position of the leading edge of the sheet S upon the pre-feeding operation is indicated by a reference numeral 286, and the size of the sheet in this case is A4.

Figure 25:
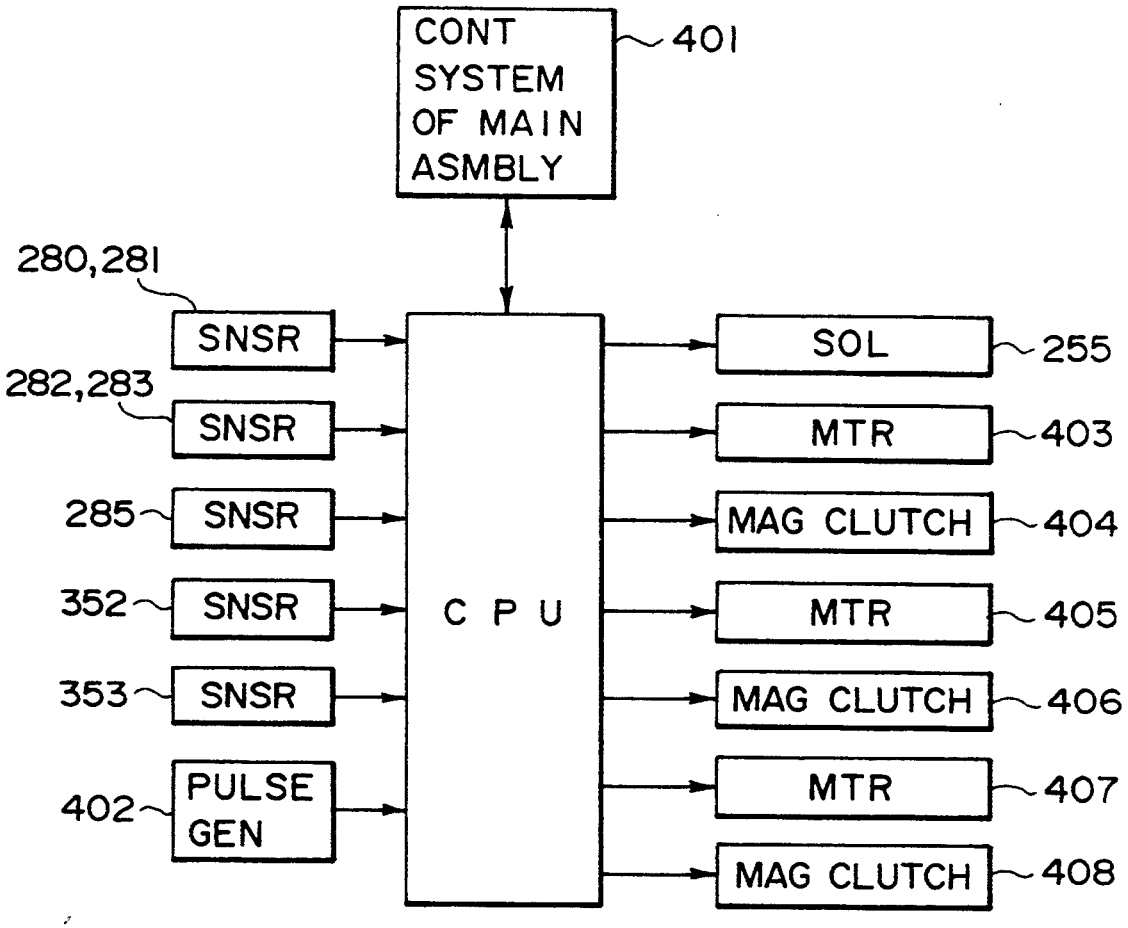
FIG. 25 is a block diagram of a control system.

FIG. 25 shows the control system, in which reference numeral 400 designates a CPU (central processing unit) which functions as a control means for effecting control of the sheet feeding operation in accordance with a program stored in a ROM not shown. The CPU 400 receives various detection signals from sensors 280–281, 282–283, 285, 352, 353. Designated by a reference numeral 401 is a control means of the main assembly 41 of the copying machine 1. The control means 401 supplies sheet feed signals or the like to the CPU 400. The CPU 400 counts the pulses generated by a pulse generator 402, and produces control signals for controlling the solenoid 255, a motor 403, an electromagnetic clutch 404, a motor 405 for driving the roller 225, electromagnetic clutch 406, the motor 407 for driving the roller 347, and the electromagnetic clutch 408 of the lower sheet feed unit.

Figure 26:
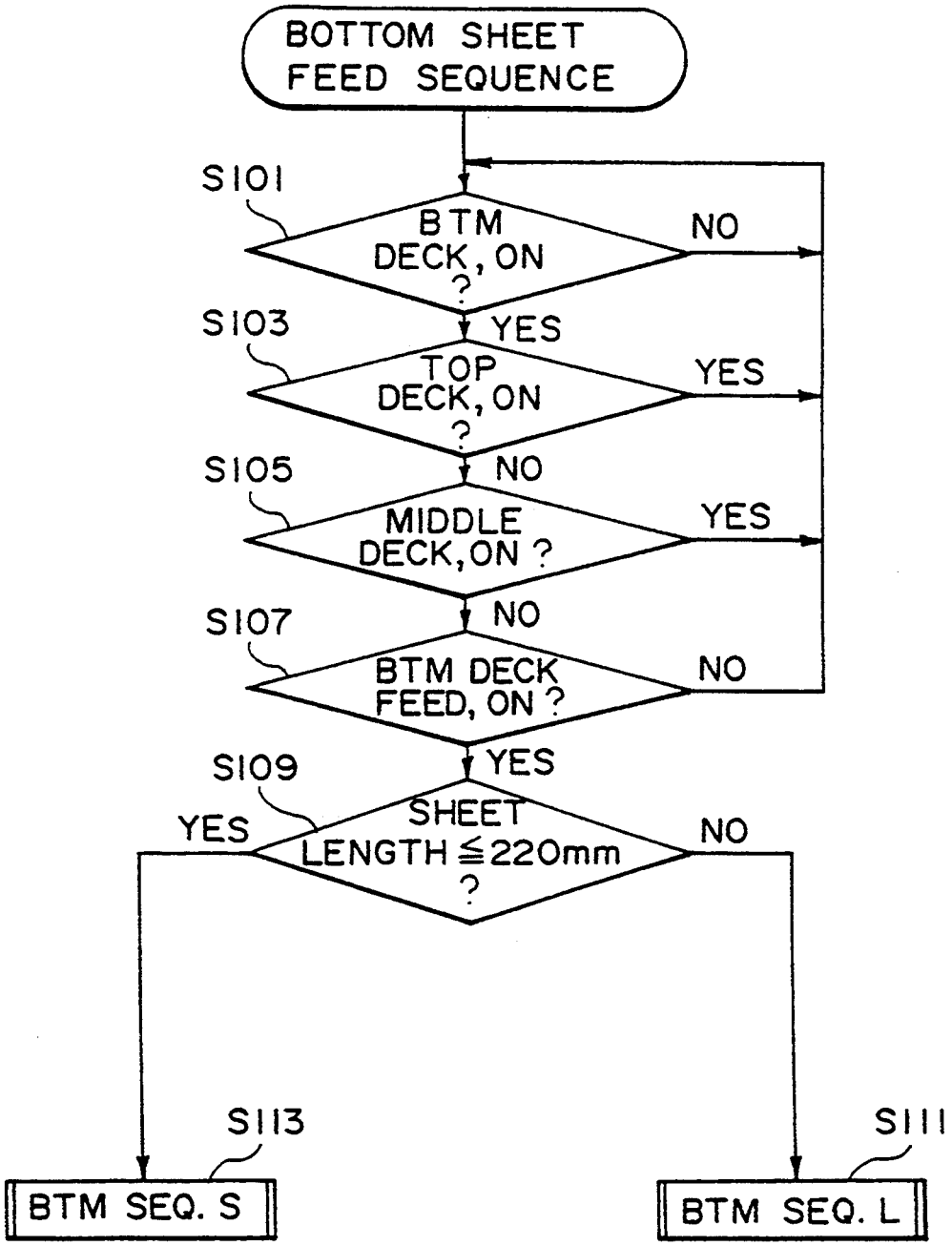
FIG. 26 is a flow chart illustrating the sequential operations in the lower sheet feeding unit.
Figure 27:
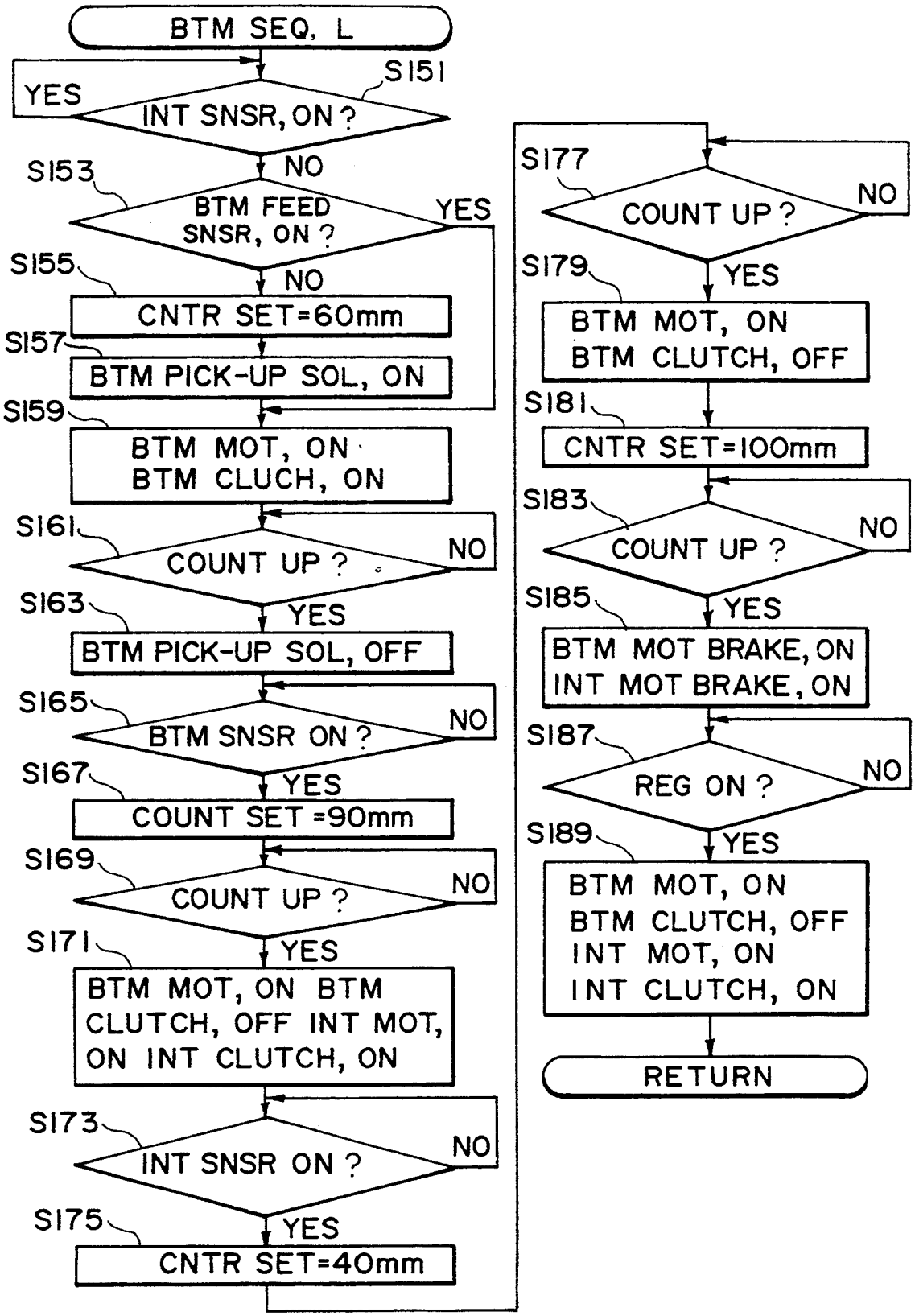
FIG. 27 is a flow chart illustrating a large side sheet conveying sequences.
Figure 29:
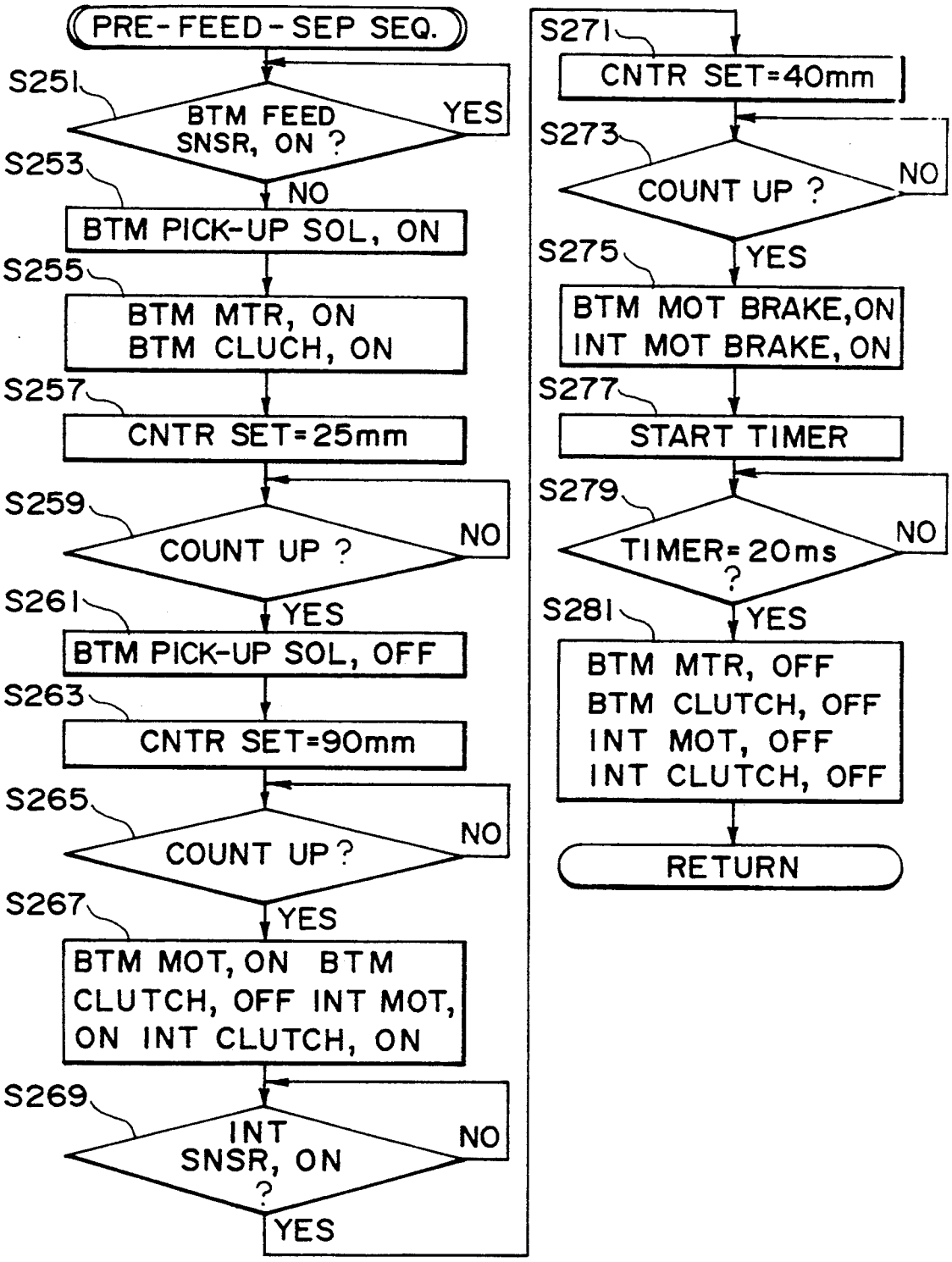
FIG. 29 is a flow chart illustrating a pre-feeding sequences.

Referring to FIGS. 26, 27 and 29, the control method using the CPU 400 for the lower sheet feeding unit will be described. FIG. 26 is a flow chart of the sheet feed sequence from the lower unit. As an initial check, a description will be made as to whether the lower deck is set or not, whether either one of the upper or middle decks are in use or not, whether the bottom deck contains sheets, and whether the lifter is lifted to permit sheet feed (S101, S103 and S104). Then, when the presence of the lower stage sheet feed signal is confirmed (S107), the sheet feed is started. If the length of the sheets stored in the lower deck is longer than 220 mm, the sheets are fed out from the lower deck 6. Otherwise, the sheets are fed in another sequence (pre-feeding sequence). In this embodiment, if the length of the sheets accommodated in the lower deck 6 is larger than 220 mm in the direction of the sheet conveyance, the lower deck sequential operations L is carried out after the initial check. If it is shorter, the control operation is effected with the lower deck sequence S and the pre-feeding sequence (which will be described hereinafter) (S109, S111, S113).

Referring to FIG. 27, a description will first be provided as to the case of the feeding of a longer sheet. In the lower deck sequence L, a discrimination is made as to whether the sheet is in the interface unit 9 (S151). If the sensor is not actuated at step S151, the operation proceeds to step S153 where the bottom deck sensor 285 is checked. If the sensor 285 is actuated, the operation proceeds to step S159. If not, a counter is set to 60 mm (S155), and the lower stage pickup solenoid is energized to contact the pickup roller to the sheet (S157). Subsequently, the lower stage motor is energized, and the lower deck clutch is engaged, so that the roller 215 is rotated (S159). When the counter counts up, the lower deck pickup solenoid is deenergized (S161, S163), and the apparatus awaits the actuation of the lower deck sensor 285. When 90 mm is counted after actuation of the lower deck sensor 285 (S165, S167 and S169), the lower deck motor and the interface motor are started, and the lower stage clutch and the interface clutch are engaged S171. When the sheet advances through 40 mm after actuation of the interface sensor 352, the lower deck clutch is disengaged (S173, S175, S177 and S179), and when the sheet is advanced further through 100 mm, the lower stage motor and the interface motor are braked to stop the sheet (S181, S183 and S185). At this time, the sheet abuts the registration rollers 13 in the main assembly 41 of the copying apparatus 1 until a proper amount of loop is formed. Upon reception of the actuation signal for the registration rollers from the main assembly of the copying machine, the processing is resumed (S187), and the lower deck motor and the interface motor are rotated, and the lower deck clutch is disengaged, and the interface clutch is engaged (S189), by which the sheet is fed to the main assembly. In this manner, the one sheet conveying sequence from the lower deck is completed.

Figure 28:
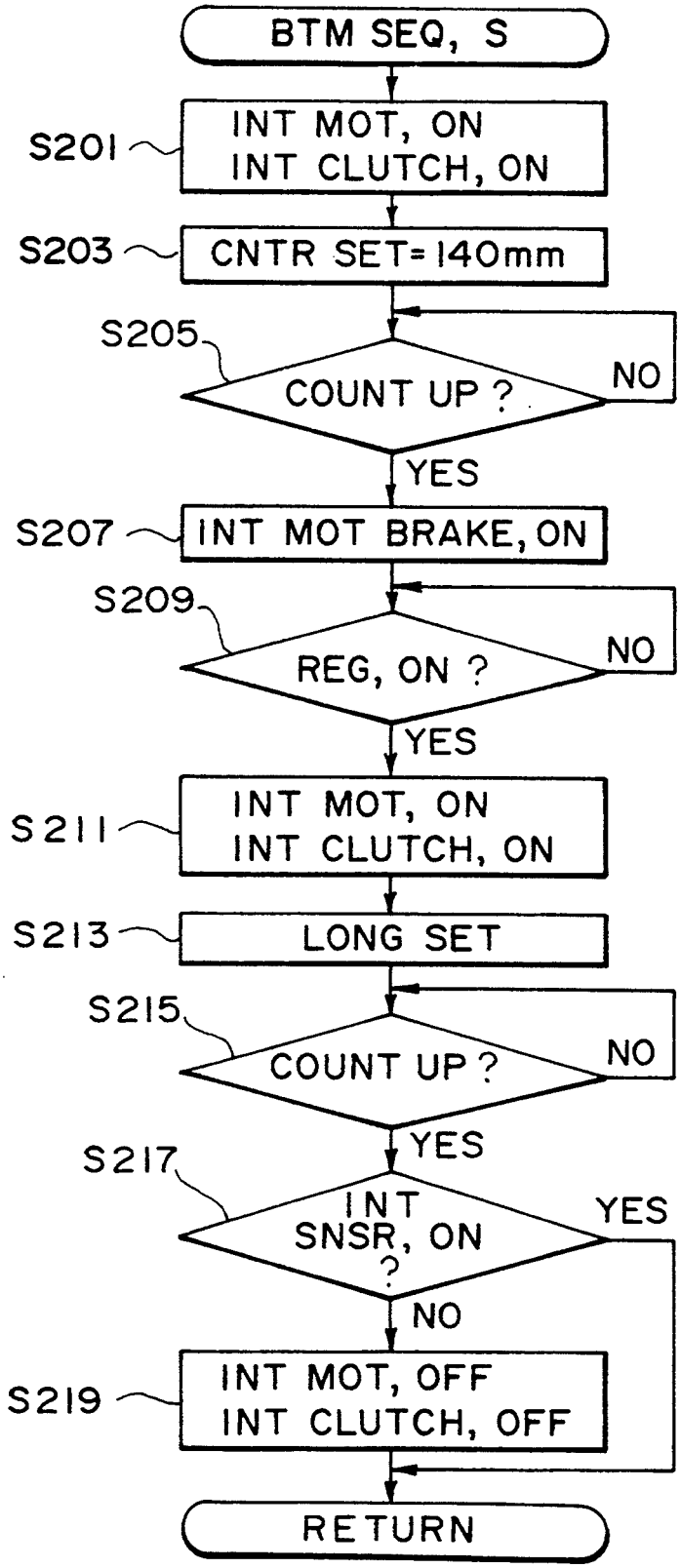
FIG. 28 is a flow chart illustrating small size sheet conveying sequences.

Referring to FIG. 28, a description will be provided as to the case of feeding shorter sheets (shorter than 220 mm). In this case, during the stand-by stage with the power switch being on, for example, the sheet is always present on the sheet passage by the pre-feeding sequence which will be described hereinafter. In response to the sheet feed signal from the main assembly of the copying machine, the sheet on the passage is supplied into the main assembly of the copying machine, and simultaneously, the next sheet is fed to the conveyance passage.

In the case of the lower deck sequence S, the interface motor is rotated, and the interface clutch is engaged (S201). When the sheet is advanced through 140 mm, the interface motor is braked to stop the sheet (S203, S205 and S207). At this time, the sheet is abutted to the registration rollers 13 in the main assembly of the copying apparatus to form a proper amount of loop. When a signal instructing actuation of the registration rollers is received from the main assembly of the copying apparatus, the processing is resumed (S209). The interface motor is rotated, and the interface clutch is engaged (S211), so as to feed the sheet into the main assembly.

Next, the length of the sheet is counted (S213 and S215), and when the sheet deactuates the interface sensor 352, the driving system is deactuated (S217 and S219). In this manner, the one sheet feed sequences from the lower deck are completed.

Referring to FIG. 29, the pre-feeding sequence will be described.

First, a discrimination is made as to whether the lower deck sheet feed sensor 285 is actuated or not (S251). If it is not actuated, the lower deck pickup solenoid is actuated (S253) to bring the pickup roller into contact with the sheet. Subsequently, the lower deck motor is rotated, and the lower deck clutch is actuated to rotate the roller 225 (S255). The counter is set to 25 mm, and when it counts up, the lower stage pickup solenoid is deenergized (S257, S259 and S261).

Then, the lower deck pickup solenoid is deactuated, and thereafter, after 90 mm is counted (S263, S265), the lower deck motor and the interface motor are rotated, and the lower deck clutch and the interface clutch are actuated (S267). When the sheet is advanced through 40 mm after actuation of the interface sensor 352, the lower deck motor and the interface motor are braked to stop the sheet (S269, S271, S273 and S275). In this manner, the conveyance in the sheet passage is completed. After 20 micro-sec. is elapsed therefrom, the pre-drive of the motor is stopped (S277, S279 and S281).

Figure 20:
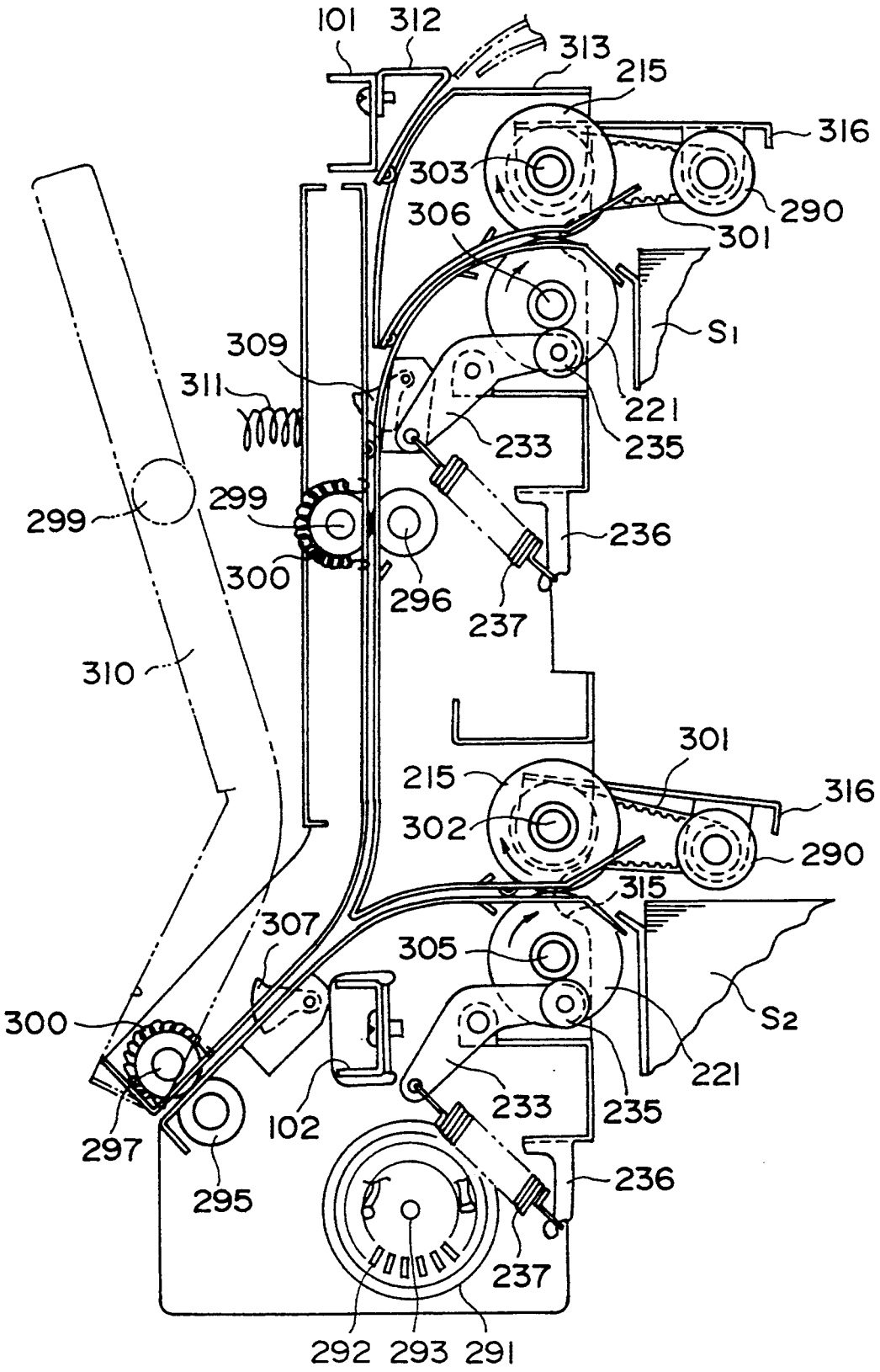
FIG. 20 is a longitudinal sectional view of an upper sheet feeding unit.

Referring to FIGS. 19 and 20, a description will be provided as to the upper sheet feeding unit 56. FIG. 19 shows the relationship between the driving belt 273 for the feeding roller 215 and the retarding roller 221, a small pulley 271, a large pulley 272 or the like, which are commonly used in the lower sheet feeding unit 7 and an upper sheet feeding unit 56. In the upper sheet feeding unit 56, similar to the lower sheet feeding unit 7, the peripheral speed of the retarding roller 221 is smaller than that of the feeding roller 215.

FIG. 20 is a longitudinal sectional view of the upper sheet feeding unit 56. In this embodiment, the upper sheet feeding unit 56 does not affect the pre-feed operation, first, because the sheet passage is not rectilinear, and second, because the pre-fed sheet becomes non-usable if the upper unit 3 is slid. Therefore, for smaller sheet sizes, it is possible that the copy speed becomes lower than the maximum copying speed of the main assembly 41 of the copying machine 1.

In order to minimize the reduction of the copy speed, the upper sheet feeding unit 56 uses a speed changeable sheet feeding system. If the sheet feed is started after the signal indicative of the existence of the outstanding original is received, the copy speed is reduced in the conventional system wherein the process speed of the main assembly is equal to the sheet feeding speed. In such a case, the sheet feeding speed is made larger than the process speed of the main assembly 41, by which the sheet is fed to the registration roller 13 quickly, so that the reduction of the copy speed is minimized. In this embodiment, such a sheet feed speed is 760 mm/sec, the process speed being 500 mm/sec.

However, it has been found that additional problems arise which are not involved in the conventional system wherein the process speed is equal to the sheet feeding speed. First, the sheet feeding speed is so high that the slippage easily occurs if the pickup roller 290 is abruptly driven by an electromagnetic clutch (not shown). Second, as described in the foregoing with respect to the lower sheet feeding unit 7, the torque limiter 266 (FIG. 18) for driving the retarding roller 221 exceeds the tolerable rotational speed by the high speed sheet feeding. Third, since the sheet feed speed is different from the process speed of the main assembly 41, the sheet S fed out possibly abuts the trailing edge of the previous sheet S.

The sequences of the operations in this embodiment are so designed to avoid these three problems. First, a description will be provided as to the structure of the upper sheet feeding unit 56.

In FIG. 20, reference numeral 291 designates a motor exclusively for driving rollers of the upper sheet feeding unit 56; 292 designates a clock plate fixedly mounted on a motor shaft 293 of the motor 291 to detect the rotational speed of the motor shaft 293.

Rollers 295 and 296 are directly driven by the motor shaft 293 by unshown belts. However, a one way clutch (not shown) is used to make them free when the sheet S is drawn out in the conveyance direction. Rollers 297 and 299 are idler rollers and are pressed to the rollers 295 and 296 respectively by a spring 300 similar to the roller 227 of FIG. 15. The upper and middle feed rollers 215, and retarding rollers 221 and rollers 235 or the like, are similar to those described in conjunction with the lower sheet feeding unit 7 (FIG. 15), so that a detailed description thereof is omitted.

However, it should be noted that the pickup roller 290 has a smaller diameter than the pickup roller 219 of the lower sheet feeding unit 7. The reasons for this are that, as will be understood from FIG. 1, the space around the pickup roller 290 becomes a dead space which reduces the sheet stacking capacity, that the upper/middle deck 43 and 45 accommodate 1000 sheets, respectively while the lower deck 6 accommodate 3000 sheets, and therefore, the reduction of the durability resulting from the reduced roller diameter does not disturb the balance in consideration of the frequency of use.

A belt 301 functions to transmit the driving force from the shaft 302 to the pickup roller 290. The shaft 302 and the shaft 303 are driven through an electromagnetic clutch between them and the motor 291. The shafts 305 and 306 of the retarding roller 221 are driven by a belt 273, similar to the case of FIG. 19. In the sheet passage, lever sensors 307 and 309 are disposed. As shown in FIG. 21, stays 101 and 102 are effective to mount the entire upper sheet feeding unit 56 to the upper unit 3, as shown in FIG. 21.

A guide 310 is rotatably supported on a pivot 310*a*, and the guide 310 is opened to the chain line position when the jam clearance is required. By the opening, the idler rollers 297 and 299 become accessible. When the guide 310 is set, it is pressed from the main assembly 41 by a spring 310 to be fixed. Guides 312 and 313 receive the sheet S from the manual sheet feeding unit 42. The sheet conveying passage is formed by guides 310A, 310B, 310C, 312 and 313.

A cut-away portion 315 of the side plate extends to the nip between the rollers 215 and 221, and is provided so that when the upper or middle deck 43 or 45 is drawn out, the sheet S having reached the nip is not damaged. A pickup arm 316 is different from that of the lower unit in that it is lifted away from the sheet S1 or S2, as in the conventional system. When the solenoid (not shown) is energized or when the upper/middle decks 43 and 45 are drawn out, the pickup arm 316 is lifted.

Sequential operations will be described which solve these three problems.

When the electromagnetic clutch is engaged while the motor 291 is being rotated at the sheet feeding speed 750 mm/sec, the slippage of the pickup roller 290 is prevented by stopping the motor 291 (speed=0) immediately before the engagement of the clutch for the purpose of rotating the pickup roller 290 and actuating the motor 291 after the clutch is engaged.

By doing so, the pickup roller 290 is accelerated by the acceleration of the motor 291 itself, and therefore, the slower acceleration than the abrupt actuation of the electromagnetic clutch can be provided, so that the slippage of the pickup roller 290 can be avoided.

When the pickup roller 290 is rotated, it is contacted to the top surface of the pickup roller 290 beforehand, by deactuating the solenoid immediately before the pickup action. When the sheet S is to be stopped, the clutch is disengaged in the conventional manner to quickly stop it. Additionally, the elimination of the high speed clutching, reduces the noise.

A description will be provided as to the prevention of the torque limiter 266 from exceeding the tolerable rotational speed.

In this embodiment, each of the rollers 215 and 221 have a diameter of 32 mm, and therefore, if the peripheral or tangential speed is 760 mm/sec, the rotational speed is 454 rpm. In a conventional system, the feeding roller 215 and the retarding roller 221 are rotated in opposite directions but at the same tangential speed. If this is done, however, the torque limiter 266 is subjected to a speed which is a sum of the rotational speeds of the rollers, and therefore, it rotates at a maximum of 908 rpm. In this embodiment, the speed of the retarding roller 221 is made one half that of the feeding roller 215, as shown in FIG. 19, by which the maximum rotational speed is reduced to 681 rpm (=(454+454)/2).

However, it is still beyond the maximum tolerable rotational speed. In consideration of this, the present embodiment is such that when the electromagnetic clutch is engaged, and the shafts 302, 305, 303 and 306 are rotated by the motor 21, the maximum speed, that is, 760 mm/sec, is given up, and the normal 500 mm/sec is used. Simultaneously with the leading edge of the sheet S being gripped by the rollers 296 and 299 or by the rollers 195 and 297, the electromagnetic clutch is disengaged, and the speed of the motor 291 is shifted up from 500 mm/sec to 760 mm/sec. By doing so, the maximum rotational speed of the torque limiter 266 can be maintained to be always not more than 454 rpm.

The measure preventing the abutment of the sheet S to the previous sheet S is done only to effect close communication with the main assembly 41 and to control the subsequent sheet S on the basis of motion of the preceding sheet by sensors arranged in the sheet passage at as fine a pitch as possible. Therefore, the detailed description thereof is omitted.

The sheet feeding apparatus 2 has two sheet passages, as described hereinbefore. Therefore, a description will be provided as to a special sheet feeding mode used only upon performing of a high speed scanning reading operation. As described hereinbefore, only the bottom deck 6 is usable for the high speed scan-reading. However, only when the sheets S having the same size as the lower deck 6 is contained in the middle deck 45, the sheets can be alternately fed from the middle deck 45 and from the lower deck 6. By doing so, the sheet intervals can be increased by a substantial extent, and the sheet feeding is further stabilized.

Figure 22:
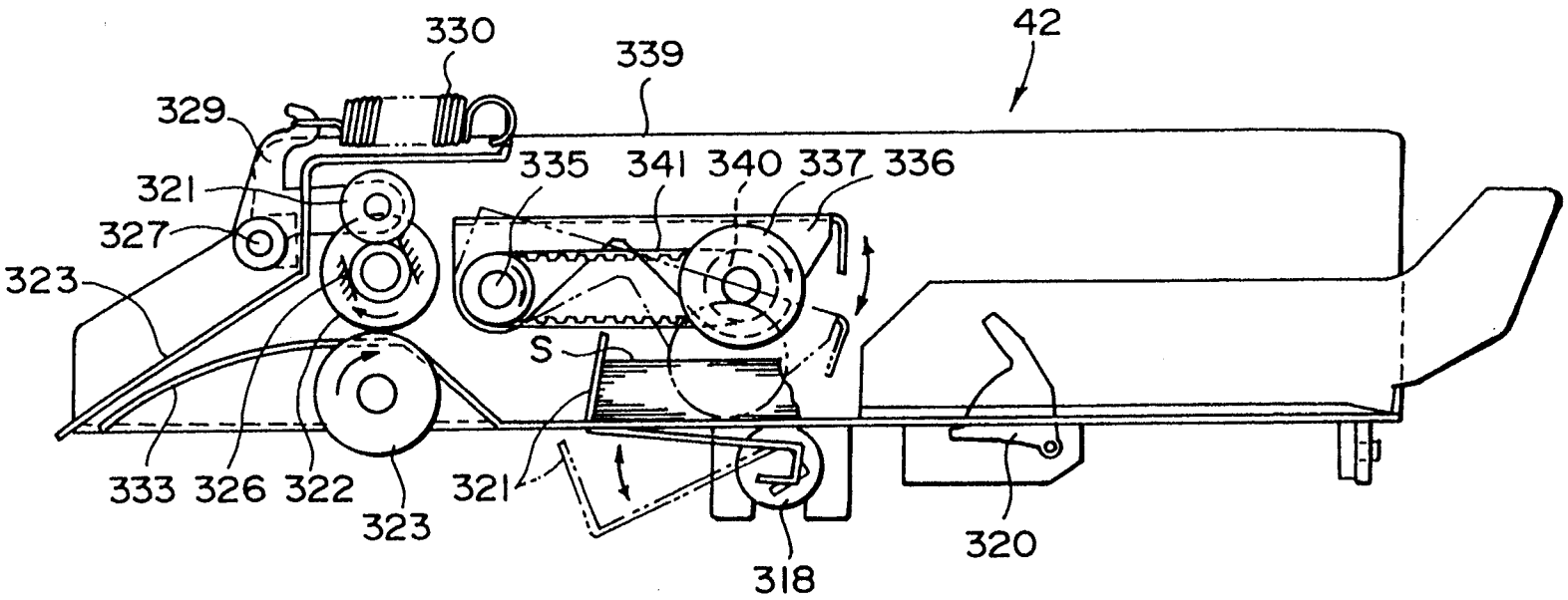
FIG. 22 is a longitudinal section view of a manual feeding unit.

FIG. 22 is a longitudinal sectional view of a manual feeding station 42. In this figure, there are shown a sheet absence sensor 320 for detecting the presence or absence of the stacked sheet S and a shutter 321 for the sheet stacking. The shutter 321 is interrelatedly moved with the transparent cover 59 shown in FIG. 2. More particularly when the cover 59 is opened to stack the sheets S, as shown in FIG. 2, the shutter 321 takes the position indicated by solid lines in FIG. 22 to prevent the operator from stacking the sheets S beyond the shutter 321. This is because a malfunction of the sheet feed can occur when the sheets S are inserted at once between the feed roller 322 and the retarding roller 323, that is, if the sheets S are inserted too much. The shutter 321 is rotatable in the direction indicated by an arrow about a shaft 318, so that when the cover 59 is closed, the shutter 321 rotates to the chain line position to permit sheet feed.

The conventional shutter for the manual sheet feed station, is directly driven by a solenoid. In order to avoid the problem that the power supply to the solenoid continues in an unlimited manner even if the solenoid is supplied with 100% power, the use is made of a spring clutch, a cam or the like to retain selected two positions of the shutter without power supply. However, since in the embodiment, the cover 59 is provided for the manual sheet feeder 42 and since it is interrelated with the shutter 321, the cost can be reduced, and simultaneously, the introduction of foreign matter into the copying machine 1 can be prevented.

The cover 59 is provided with an unshown open-close sensor so as to prevent the sheet feeding operation unless the cover 59 is closed.

To the frame of the manual sheet feed 42, a feed roller 322 is rotatably mounted, and the retarding roller 323 press-contacted thereto is driven through a torque limiter, not shown. The shaft of the feed roller 322 is slidable in a groove 326 and is driven through a universal joint not shown. The groove 326 is slightly inclined so as to increase the pressing force to the retarding roller 323 when the driving force is applied, as described in conjunction with FIG. 15.

A pressing lever 329 rotatably supported on the shaft 327 is urged in the clockwise direction by a spring 330, and a pressing roller 331 rotatably supported on the lever 329 urges the shaft of the feeding roller 322. Downstream of the rollers 322 and 323, there are sheet feed guides 332 and 333 for guiding the fed sheet S.

A pickup roller 336 having an end portion rotatably mounted on the shaft 335 at its base portion, has a free end portion on which the pickup roller 337 is rotatably mounted. A pulley 339 mounted on the shaft 335 and a pulley 340 mounted on the shaft of the pickup roller 337 are operatively connected by a belt 341. Upon actuation of the solenoid, the pickup roller 337 falls by the weight thereof on the sheet S to the chain line position to be press-contacted thereto. The manual sheet feeder 42 is driven a dedicated motor (not shown), and is not provided with a clutch such as an electromagnetic clutch, and therefore, the sheet feed operation is controlled only by the rotational speed control of the motor.

As shown in FIG. 1, the top cover 57 functions also as a tray for the manual feed station. It rises with an increased arcuation toward the right side to have a maximum height at an edge of the cover 57. Therefore, the sheets S are more easily handled than when the cover 59 is flat as indicated by chain lines 342.

FIG. 23 is a detailed sectional view of the interface unit 9. When the sheet feeding apparatus 2 is attached to the main assembly 41 of the copying machine 1, the interface unit 9 replaces the cassettes. By an unshown dedicated motor, rollers 345 and 347 are driven through an electromagnetic clutch. Idler rollers 346 and 349 are press-contacted to the rollers 345 and 347. A sheet feed passage 350 is provided with sheet detecting sensors 352 and 353, and the upper sheet feed passage 351 is provided with a sheet detecting sensor 355. Reference numerals 356 and 357 designate fixed guides; 359 and 360, denote movable guides releasable upon jam clearance operation. The movable guides 359 and 360 are fixed by the free end rollers 363 and 365 being pushed in a direction P by leaf springs 361 and 362 mounted on the upper unit 3.

Because of the structure of the interface unit 9 as described above, when the upper unit 3 is slid in the direction indicated by an arrow 83 (FIG. 5) upon the jam clearance operation, the guides 359 and 360 open the sheet feed passages 350 and 351 about the shafts 366 and 367, and therefore, the jam clearance operation is made easier.

The sheet 286 pre-fed (FIG. 1) is detected at its leading edge by the sensors 352 and, and after the clock is counted, it is stopped at a predetermined position. The sensor 353 is not necessarily required. However, in consideration of the possibility that the microcomputer looses data relating to the stopping position due to a power shut off or that the position of the pre-fed sheet is changed by the operator or the like, the sensor 353 is disposed downstream of the stop position of the leading edge of the pre-fed sheet 286 and upstream of the registration rollers 13 of the main assembly 41.

By using the two sensors 352 and 353 and by interposing the leading edge of the pre-fed sheet 286 therebetween, the pre-fed sheet S 286 can be completely controlled.

Figure 24:
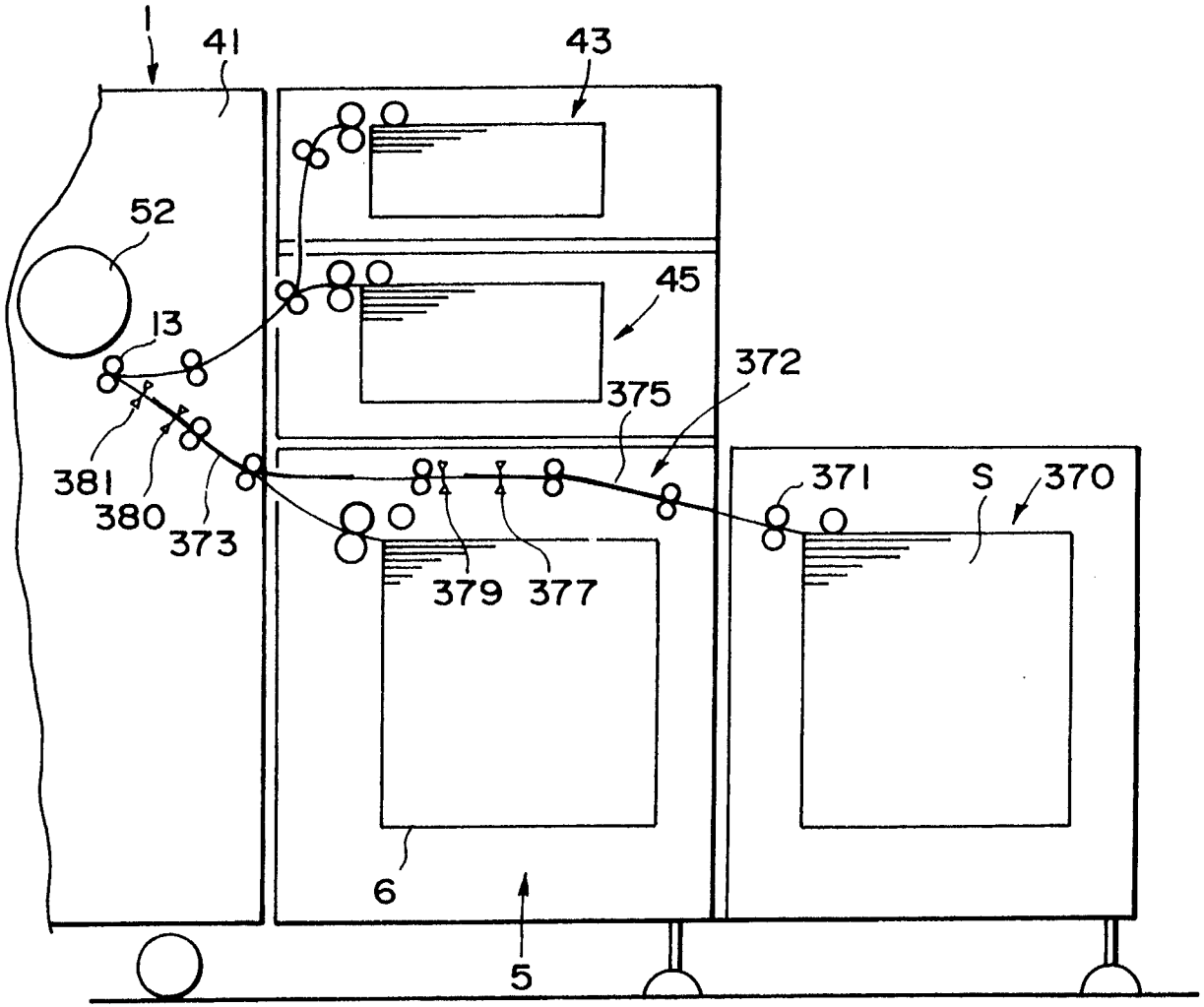
FIG. 24 shows a general arrangement of the apparatus according to a second embodiment of the present invention.

In this embodiment, only one sheet is pre-fed, but the number thereof may be two or more if the sheet passage is very long. In FIG. 24, the lower unit 5 has an additional deck 370. The distance L between the separating portion 371 of the deck 370 and the registration rollers 13 of the main assembly is very large, as measured along the sheet passage 372.

When the sheet passage 372 having a large length L, is required, the distance L is determined so as to be an integer multiplied by (length of the sheet S in the sheet conveyance direction+sheet intervals upon continuous copy operation), and the size of the sheet S is also selected to satisfy the above. Then, it is possible to prefeed two sheets 373 and 375. In the sheet passage 372, sheet detection sensors 377, 379, 380 and 381 are disposed. As described in the foregoing, the pre-fed sheets 373 and 375 are watched.

In this case, the sheet S has a long size, and the same advantageous effects can be obtained if the number of pre-fed sheets rather than the size of the sheet is reduced.

In this embodiment, the device awaits for sheet and retains the sheet in the sheet passage so that the trailing edge thereof is downstream of the nip formed between the feeding roller 215 and the retarding roller 221. If, however, the length of the sheet passage is not sufficient as compared with the length of the sheet, the trailing edge of the sheet may be between the nip and the lower deck 6 (within the range a in FIG. 15), when it is retained. In this embodiment, the feeding roller 215 and the retarding roller 221 are mounted on the base 212, and therefore, even if the lower deck 6 is drawn out, the retained sheet is not torn.

Figure 32:
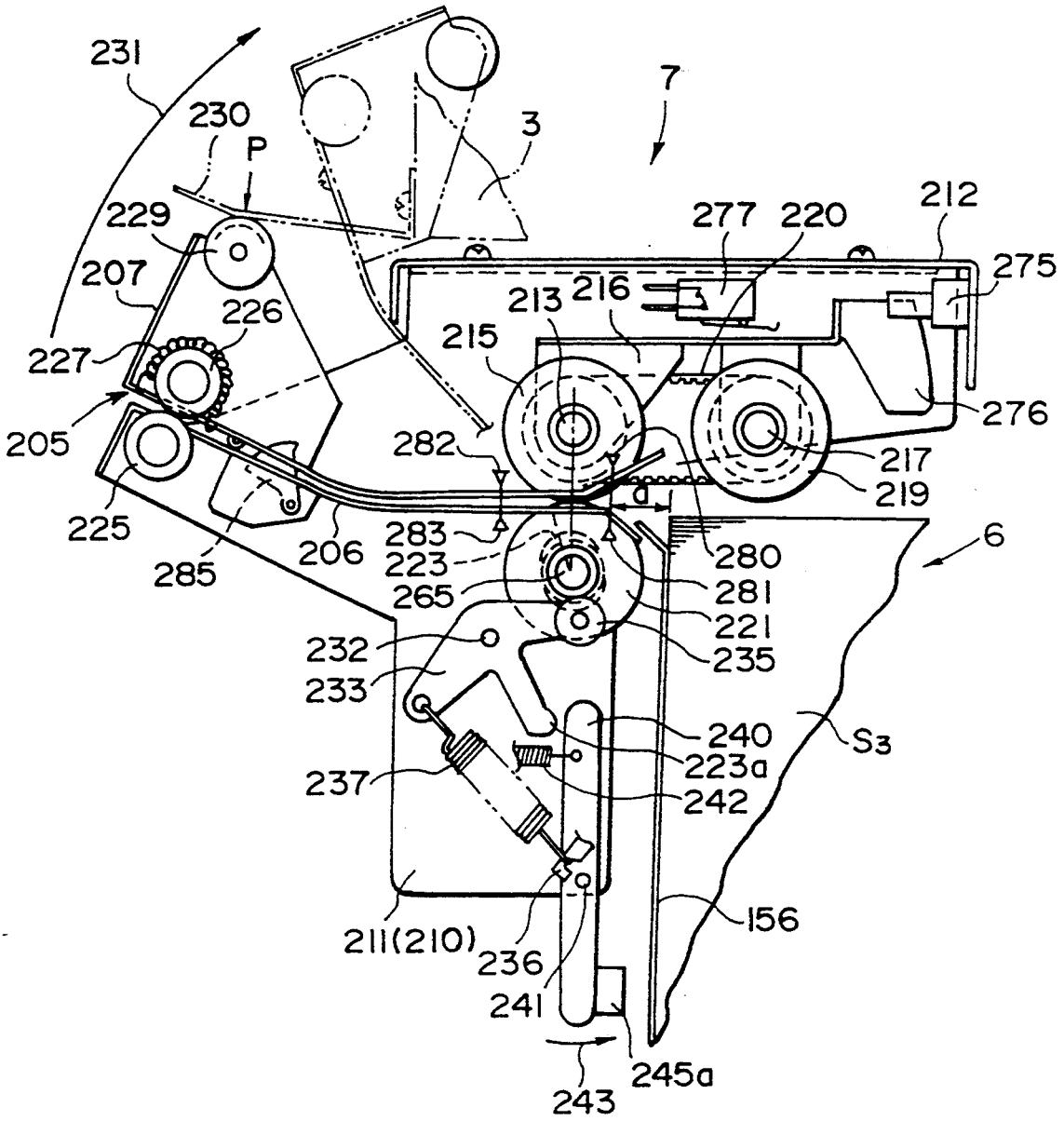
FIG. 32 is a longitudinal sectional view of a lower unit of a sheet feeding apparatus according to a further embodiment of the present invention.

In the case where the feeding roller 215 and the retarding roller 221 are mounted on the lower deck 6, an urging member 245*a* shown in FIG. 32 rather than the urging member 245 shown in FIG. 15 is mounted on the base 121 rather than the lower deck 6. By doing so, when the lower deck 6 is drawn out, the rollers 215 and 221 may be moved away from each other, so that the end portions of the retained sheet is not torn.

In the foregoing description, an image forming apparatus of an electrophotographic copying machine type has been discussed although taken, another type of image forming apparatus is usable. As an example, an ink jet recording system is usable.

In an ink jet recording system, there are ejection outlets for detecting recording ink droplets, liquid passages in communication with the ejection outlets, and ejection energy generating means at a part of the liquid passages to produce ejection energy to eject the ink droplets. In response to an image signal, the ejection energy generating means is driven to eject imagewisely the ink droplets to effect the recording.

As for the ejection energy generating means, there are a pressure energy generating means such as electromechanical converter (piezoelectric element, for example) an electromagnetic energy generating means for applying electromagnetic wave (laser, for example) to the ink liquid to produce sheet and for ejecting the ink by the heat generation, and an electrothermal transducer for heating the ink liquid to eject the ink, or the like. Among them, the system using the electrothermal transducer or the like to produce the thermal energy is preferable from the standpoint of the high resolution recording (the ejection outlets can be arranged at a high density) and the reduction of the size of the recording head.

A description will be provided as to a serial type liquid jet recording system which is an ink jet recording system.

Figure 30:
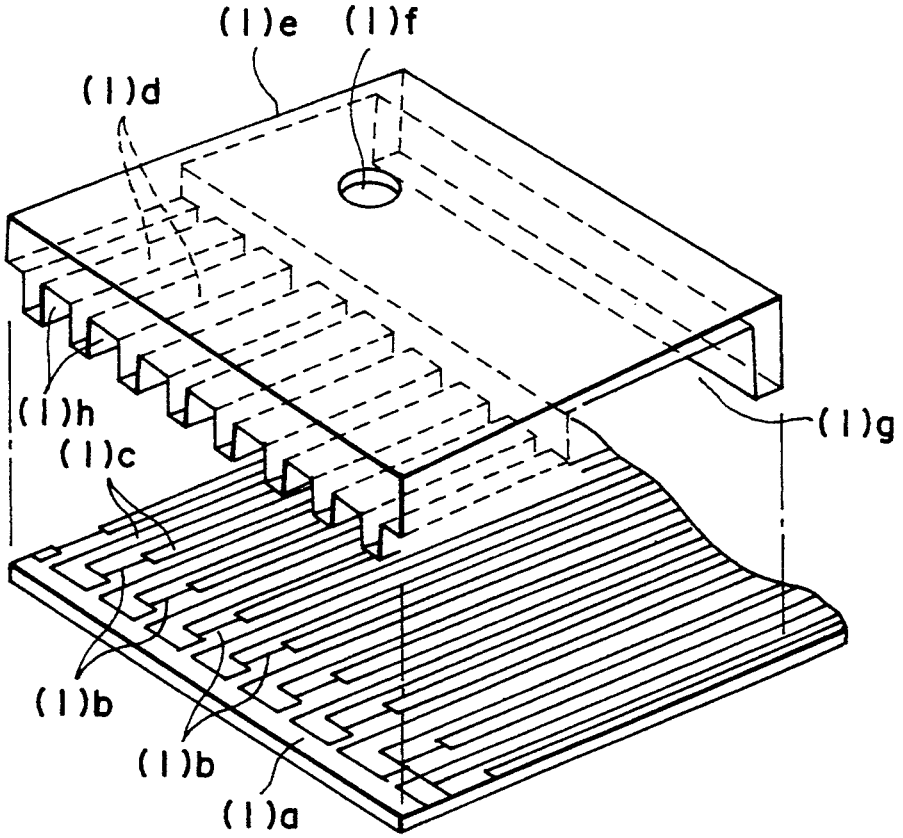
FIG. 30 is an exploded perspective view of a recording head used in an image forming apparatus of a liquid jet recording system.
Figures 31A, 31B, 31C, 31D, 31E, 31F, 31G:
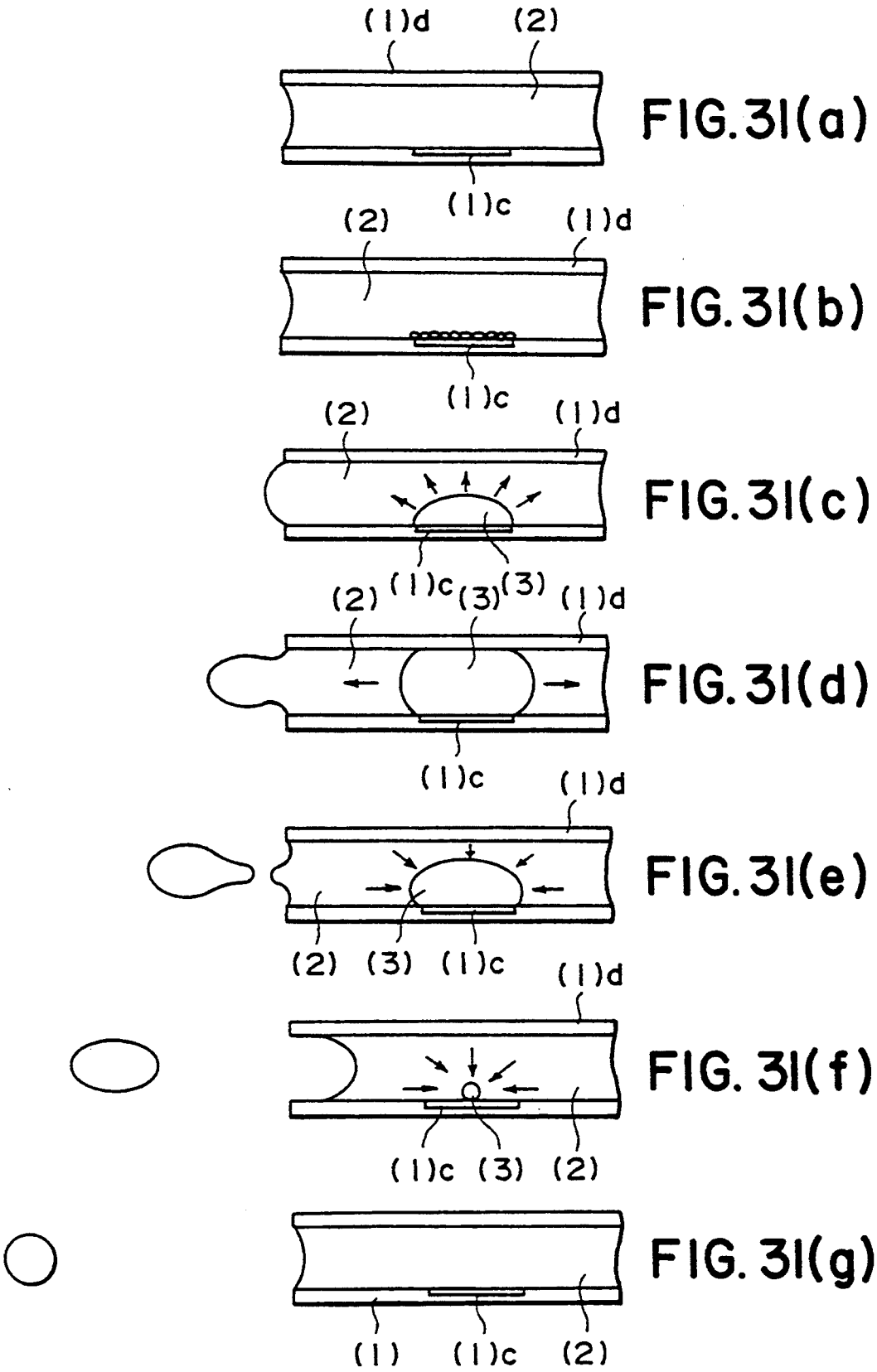
FIGS. 31A, 31B, 31C, 31D, 31E, 31F and 31G illustrate the recording principle of a liquid jet recording.

FIG. 30 is an exploded view of the recording head (1), and FIG. 31 illustrates the liquid jet recording principle. A typical structure and principle are disclosed in U.S. Pat. Nos. 4,723,129 and 4,740,796.

In FIG. 30, a heater board (1)*a* is provided with a silicone substrate and electrothermal transducer element (ejection heaters) (1)*b*, and electrodes (1)*c* made of aluminum or the like for supplying electric power thereto. They are produced by a film producing process. To the heater bard (1)*a*, a top plate (1)*e* is bonded, and the top plate has partition walls for defining liquid passages (nozzles) (1)*d* for the recording liquid. At a predetermined position of the apparatus, an ink cartridge is detachably mounted to supply ink to the recording head (1).

The ink supplied through a conduit from the ink cartridge fills a common liquid chamber (1)*g* in the recording head (1) through a supply port (1)*f* formed in the top plate (1)*e*, and is introduced into the respective nozzles (1)*d* from the common chamber (1)*e*. The nozzle (1)*d* have an ink ejection outlet (1)*h*, and the ejection outlets (1)*h* are formed at a predetermined intervals in the sheet conveyance direction facing to the recording sheet.

In this embodiment, the recording head (1) is carried on a reciprocable carriage, and in synchronism with the carriage movement, the ink is ejected from the recording head (1) so as to effect image recording.

Referring to FIG. 31, the ink ejection principle in the liquid jet recording system, will be described.

In the non-actuated state, as shown of FIG. 1, (*a*), the ink (2) filling the nozzle (1)*d* is balanced at the ejection outlet surface by the surface tension and the external pressure. In order to eject the ink, the electrothermal transducer (1)*b* in the nozzle (1)*d* is energized to produce an instantaneous temperature rise of the ink in the nozzle (1)*d* beyond a nucleate boiling point. Then, as shown in FIG. 31(*b*), the ink adjacent to the electrothermal transducer (1)*b* is heated, by which a fine bubble is produced, and the ink heated evaporates to produce a film boiling, and the bubble (3) rapidly develops as shown in FIG. 31(*c*).

When the bubble develops most, as shown in FIG. 31(*d*), a droplet of the ink liquid is ejected through the ejection outlet of the nozzle (1)*d*. Upon termination of the power supply to the electrothermal transducer (1)*b*, the bubble (3) collapses by the cooling by the ink (2) in the nozzle (1)*d*, as shown in FIG. 31, (*e*). By the expansion and collapse of the bubble, the ink liquid is ejected through the ejection outlet. As shown in FIG. 31, (*f*), the ink contacts the electrothermal transducer (1)*b* surface and is quickly cooled, by which the bubble (3) extinguishes or collapses to a negligible extent. When the bubble (3) collapses, the ink is supplied from the common chamber (1)*g* into the nozzle (1)*d* by the capillary action, and is prepared for the next power supply.

Therefore, an image is recorded on a recording sheet by supplying the power to the electrothermal transducers (1)*b* in accordance with image signals in synchronism with the reciprocal movement of the carriage.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:

sheet accommodating means for accommodating a stack of sheets;

feeding means for feeding one by one the sheets from said sheet accommodating means;

image forming means for forming an image on a sheet fed from said sheet accommodating means by said feeding means;

a sheet conveying path for guiding the sheet from said accommodating means to said image forming means; and control means for causing the sheet to be pre-fed and retained in said sheet conveying path when the sheet in said sheet accommodating means has a size not larger than a predetermined size, and for not doing so when the sheet in said sheet accommodating means has a size larger than the predetermined size.

2. An apparatus according to claim 1, wherein said control means, when the sheet to be fed to said image forming means reaches a predetermined position, instructs the feeding of the next sheet and the retaining of the next sheet in the conveying path.

3. An apparatus according to claim 1, further comprising detecting means for detecting a trailing edge of the sheet, wherein said control means is responsive to said detecting means so that the sheet is retained with a trailing edge thereof downstream of said feeding means.

4. An apparatus according to claim 1, further comprising a pair of rollers for retaining the sheet fed from said sheet accommodating means, said rollers being disposed upstream of registration means disposed downstream of said conveying path.

5. An apparatus according to claim 4, wherein said control means drives said rollers in response to a sheet feeding signal to feed the sheet to the registration means.

6. An apparatus according to claim 1, wherein after said sheet accommodating means is replenished with sheets, said control means feeds a sheet from said sheet accommodating means and retains the sheet fed from said sheet accommodating means in the conveying path.

7. An apparatus according to claim 6, further comprising a pair of rollers for retaining the sheet fed from said sheet accommodating means, said rollers being disposed upstream of registration means disposed downstream of said conveying path.

8. An apparatus according to claim 7, wherein said control means drives said rollers in response to a sheet feeding signal to feed the sheet to the registration means.

9. An apparatus according to claim 1, further comprising conveying means, disposed in the conveying path, for feeding the retained sheet out of the conveying path, registration means downstream of said conveying path, wherein said control means controls said conveying means to once retain the sheet and thereafter cause the sheet to abut said registration means when the size of the sheet is not larger than the predetermined size, and to cause the sheet to directly abut said registration means from said sheet accommodating means when the size of the sheet is larger than the predetermined size.

10. An apparatus according to claim 1, further comprising a plurality of said sheet accommodating means, each provided with the conveying path.

11. An apparatus according to claim 1, wherein said sheet accommodating means is of a front loading type.

12. An apparatus according to claim 1, wherein said feeding means is separable from said sheet accommodating means.

13. An apparatus according to claim 1, wherein said feeding means is mounted on said sheet accommodating means.

14. An apparatus according to claim 1, wherein said conveying path is substantially rectilinear.

15. An apparatus according to claim 1, wherein said conveying path has a length sufficient to retain two or more sheets therealong.

16. An apparatus according to claim 1, wherein said image forming means is of an ink jet recording type.

17. An apparatus according to claim 1, wherein said image forming means includes an electrothermal transducer responsive to image signals to produce thermal energy to eject ink.

18. An apparatus according to claim 1, wherein said image forming means includes an electrothermal transducer responsive to image signals to produce thermal energy to generate a bubble to cause film boiling to eject ink.

19. An image forming apparatus, comprising:

image forming means for forming an image on a sheet;

sheet accommodating means for accommodating a stack of sheets;

feeding means for feeding one by one the sheets from said sheet accommodating means;

a sheet conveying path having a sufficient length to retain the sheet from said accommodating means between said feeding means and said image forming means;

sheet conveying means for conveying a sheet fed from said sheet accommodating means by said feeding means along said sheet conveying path; and control means for controlling said feeding means and said sheet conveying means so that the sheet is pre-fed prior to generation of a sheet feeding signal and retained in the conveying path when a size of the sheet accommodated in said accommodating means is not larger than a predetermined size, and the sheet is fed without pre-feed and retention in the conveying path when the size is larger than the predetermined size.

20. An apparatus according to claim 19, wherein said control means, when the sheet to be fed to said image forming means reaches a predetermined position, instructs the feeding of the next sheet and the retaining of the next sheet in the conveying path.

21. An apparatus according to claim 19, further comprising detecting means for detecting a trailing edge of the sheet, wherein said control means controls, in response to said detecting means, said sheet conveying means to retain the sheet so that a trailing edge of the sheet is downstream of said feeding means.

22. An apparatus according to claim 19, wherein after said sheet accommodating means is replenished with sheets, said control means feeds a sheet from said sheet accommodating means and retains the sheet in the conveying path.

23. An apparatus according to claim 19, further comprising a plurality of said sheet accommodating means, each provided with the conveying path.

24. An apparatus according to claim 19, wherein said sheet accommodating means is of a front loading type.

25. An apparatus according to claim 19, wherein said feeding means is separable from said sheet accommodating means.

26. An apparatus according to claim 19, wherein said feeding means is mounted on said sheet accommodating means.

27. An apparatus according to claim 19, wherein said feeding means is mounted on said sheet accommodating means, and when said sheet accommodating means is moved in the crossing direction, said feeding means releases the sheet.

28. An image forming apparatus, comprising:

a plurality of sheet accommodating means for accommodating sheets having a size not larger than a predetermined size and sheets having a size larger than the predetermined size;

feeding means for feeding one by one the sheets from said sheet accommodating means;

image forming means for forming images on the sheets fed from said sheet accommodating means, a plurality of sheet conveying paths, connected with the plurality of said sheet accommodating means, for guiding the sheet from said accommodating means to said image forming means; and control means for pre-feeding the sheets from said sheet accommodating means accommodating the not larger sheets and retaining the sheet in said sheet conveying path and for not pre-feeding the sheet from said sheet accommodating means accommodating the larger sheet.

29. An apparatus according to claim 28, wherein said control means feeds the sheets from said sheet accommodating means accommodating the smaller size sheet and retains the sheets in said conveying path, prior to generation of a sheet feeding signal.

30. An apparatus according to claim 29, wherein said control means, when the sheets reaches a predetermined position in said conveying path, feeds a next sheet and retain the next sheet in said conveying path.

31. An apparatus according to claim 29, wherein said control means feeds the sheets from said sheet accommodating means accommodating smaller size sheets and retains the sheets in said conveying path after said sheet accommodating means is replenished with the sheets.

32. A sheet feed control method wherein sheets are fed out one by one by feeding means from sheet accommodating means, and images are formed on the sheets by image forming means, comprising the steps of:

pre-feeding, prior to generation of a sheet feeding signal, a sheet from the sheet accommodating means and retaining the sheet at a position between the feeding means and the image forming means when a size of the sheet accommodated in said accommodating means is not larger than a predetermined size, wherein the sheet is not pre-fed when the size of the sheet is larger than the predetermined size; and feeding the pre-fed and retained sheet to the image forming means in response to the sheet feeding signal.

33. A method according to claim 32, further comprising the steps of retaining the sheet at a position between registration means and the feeding means, and feeding the sheet to the registration means in response to the sheet feeding signal, and thereafter, feeding the sheet from the registration means to the image forming means.

34. A method according to claim 32, further comprising the step of, when the sheet reaches a predetermined position, feeding a next sheet to a position for retention.

35. A method according to claim 32, further comprising the step of, after the sheet accommodating means is replenished with the sheets, feeding the sheet to the position for retention.

36. A sheet feed control method wherein sheets are fed out one by one by feeding means from a plurality of sheet accommodating means having a size not larger than a predetermined size and sheets having a size larger than the predetermined size, and images are formed on the sheets by image forming means, comprising the steps of:

pre-feeding prior to generation of a sheet feeding signal, from said sheet accommodating means accommodating the not larger size sheets, wherein the sheet from said sheet accommodating means accommodating the large size sheets is not prefed; and feeding the pre-fed sheet to the image forming means in response to the sheet feeding signal.

* * * * *

UNITED STATES PATENT AND TRADEMARK OFFICE

CERTIFICATE OF CORRECTION

PATENT NO. : 5,390,016

DATED : February 14, 1995

INVENTOR(S) : AKIMITSU HOSHI, ET AL.

It is certified that error appears in the above-indentified patent and that said Letters Patent is hereby corrected as shown below:

On drawing sheet, Figure 27,
in Step S159, "CLUCH" should read --CLUTCH--.

Figure 29,
in Step S255, "CLUCH" should read --CLUTCH--.

Column 1,
line 63, "principle" should read --principal--.

Column 3,
line 25, "a" should be deleted..

Column 5,
line 64, "caster 80" should read --casters 80--.

Column 7,
line 17, "pulley" should read --pulleys--; and
line 65, "arrow 142" should read --arrow 141--.

Column 10,
line 17, "For the" should read --For these--; and
line 48, "position 189" should read --projection 189--.

UNITED STATES PATENT AND TRADEMARK OFFICE

CERTIFICATE OF CORRECTION

PATENT NO. : 5,390,016

DATED : February 14, 1995

INVENTOR(S) : AKIMITSU HOSHI, ET AL.

It is certified that error appears in the above-indentified patent and that said Letters Patent is hereby corrected as shown below:

Column 13,
line 27, "minutes" should read --minute--; and
line 43, "severe" should read --a severe--.

Column 14,
line 42, "direction 252" should read --direction 262--.

Column 15,
line 33, "sheet" should read --sheets--.

Column 17,
line 13, "drawing" should read --draw--;
line 49, "electromag" should read --an electromag--; and
line 57, "made" should read --provided--.

Column 18,
line 2, "operations L" should read --operation L--.

Column 20,
line 32, "date" should read --dates--.

UNITED STATES PATENT AND TRADEMARK OFFICE

CERTIFICATE OF CORRECTION

PATENT NO. : 5,390,016

DATED : February 14, 1995

INVENTOR(S) : AKIMITSU HOSHI, ET AL.

It is certified that error appears in the above-indentified patent and that said Letters Patent is hereby corrected as shown below:

Column 21,
line 41, "rollers 195" should read --rollers 295--; and
line 56, "performing" should read --a performing--.

Column 22,
line 54, "driven" should read --driven by--.

Column 23,
line 24, "looses" should read --loses--.

Column 24,
line 9, "discussed although taken," should read --discussed, although--;
line 18, "imagewisely" should read --imagewise--;
line 25, "sheet" should read --heat--; and
line 58, "a" should be deleted.

Column 28,
line 9, "sheets" should read --sheet--.

Signed and Sealed this

Sixth Day of June, 1995

Bruce Lehman

BRUCE LEHMAN

*Commissioner of Patents and Trademarks*

*Attest:*

*Attesting Officer*